US009226598B1

(12) United States Patent
Knope et al.

(10) Patent No.: US 9,226,598 B1
(45) Date of Patent: Jan. 5, 2016

(54) SINGLE-SERVE SANITARY MODULE DISPENSING SYSTEM

(71) Applicants: William J Knope, New Britain, CT (US); Frank L Lenge, Southington, CT (US)

(72) Inventors: William J Knope, New Britain, CT (US); Frank L Lenge, Southington, CT (US)

( * ) Notice: Subject to any disclaimer, the term of this patent is extended or adjusted under 35 U.S.C. 154(b) by 24 days.

(21) Appl. No.: 13/869,043

(22) Filed: Apr. 24, 2013

Related U.S. Application Data

(60) Provisional application No. 61/637,847, filed on Apr. 24, 2012.

(51) Int. Cl.

| | |
|---|---|
| ***B65H 1/00*** | (2006.01) |
| ***B65H 3/00*** | (2006.01) |
| ***A47F 1/04*** | (2006.01) |
| ***A47F 1/08*** | (2006.01) |
| *A47F 1/10* | (2006.01) |

(52) U.S. Cl.
CPC . *A47F 1/085* (2013.01); *A47F 1/08* (2013.01); *A47F 2001/103* (2013.01)

(58) Field of Classification Search
CPC ..... A47F 1/085; A47F 1/00; A47F 2001/103; A47F 1/08
USPC ..... 221/309, 197, 92, 239, 251, 155, 258, 221/281; 211/70.7, 59.2; 312/42
See application file for complete search history.

(56) References Cited

U.S. PATENT DOCUMENTS 730,871 A * 6/1903 Callander ..... 221/155
1,693,231 A 11/1928 Gruber
2,110,189 A 3/1938 Seidler, Sr.
2,110,491 A * 3/1938 Martti ..... G03C 1/04 106/170.51
2,141,684 A * 12/1938 Diemer ..... A47F 1/10 221/239
2,147,086 A * 2/1939 Bryan ..... A47F 1/08 206/45.24
2,149,099 A * 2/1939 Phinney ..... A47F 1/10 221/14
2,325,604 A * 7/1943 Gibbs ..... A47F 1/04 211/59.2
2,340,561 A * 2/1944 Renfro ..... 312/42
2,516,997 A * 8/1950 John ..... A63F 7/305 221/188
2,871,079 A * 1/1959 Barrett ..... A47F 1/04 312/42
2,911,127 A * 11/1959 Louis ..... G07F 11/72 221/197

(Continued)

*Primary Examiner* — Rakesh Kumar
(74) *Attorney, Agent, or Firm* — Dorothy S. Morse

(57) ABSTRACT

A single-serve, sanitary, gravity-feed cutlery dispensing system without moving parts that holds 4-to-5 times the cutlery in prior art dispensers. Its base unit holds multiple refillable dispensing modules each having a valley at the bottom of a vertically-extending storage channel with a length dimension shorter than the cutlery housed therein, thus stored utensils have angled stacking while moving downwardly toward the valley. When one end of the bottommost utensil engages the valley, it becomes locked into a horizontally-extending dispensing position with opposing end user accessible. The utensil in the dispensing position blocks removal of stacked utensils remaining in the channel. Only withdrawal of the bottommost utensil causes a next utensil to drop down into the locked dispensing position. This arrangement also prevents reinsertion of dispensed utensils. Cutlery of any design is usable with the dispensing system, and dispensing occurs equally well with the handle or opposite end engaging the valley.

20 Claims, 14 Drawing Sheets

(56) References Cited

U.S. PATENT DOCUMENTS 3,132,765 A * 5/1964 Alex ..... A47G 21/14 221/263
3,313,448 A * 4/1967 Wayne ..... A47F 1/08 221/185
3,744,866 A * 7/1973 Cook ..... A47F 1/08 211/59.2
3,957,174 A * 5/1976 Palamara ..... 221/111
4,246,915 A * 1/1981 Hall ..... G07D 1/08 453/50
4,767,022 A * 8/1988 Oldorf ..... 221/92
4,850,511 A * 7/1989 Kral ..... A47F 1/08 221/154
5,016,766 A * 5/1991 Klein ..... A61C 7/306 221/22
5,065,897 A * 11/1991 Smith ..... B65G 59/067 221/130
5,190,168 A 3/1993 French
5,294,020 A * 3/1994 Kunz ..... A47F 1/08 221/1
5,295,592 A * 3/1994 Thorne ..... A47F 1/08 211/59.2
5,706,977 A * 1/1998 Ogura ..... A47F 1/08 221/197
5,794,817 A * 8/1998 Rosa ..... A47F 1/08 193/47
5,855,422 A * 1/1999 Naef ..... A47F 1/08 211/59.2
5,921,408 A * 7/1999 Groenewold et al. ..... 211/70.7
8,272,533 B1 * 9/2012 D'Amelia et al. ..... 221/197
2004/0188365 A1 * 9/2004 Forte ..... 211/49.1

* cited by examiner

SINGLE-SERVE SANITARY MODULE DISPENSING SYSTEM

CROSS-REFERENCES TO RELATED APPLICATIONS

Since this application has the same title and substantially the same subject matter as U.S. provisional patent application 61/637,847 that was filed last year on Apr. 24, 2012, by inventors/applicants William J. Knope and Frank L. Lenge, the same inventors/applicants herein respectfully request that domestic priority be granted for their U.S. utility patent application now being filed based upon their previously filed U.S. provisional patent application 61/637,847.

BACKGROUND OF THE INVENTION

1. Field of the Invention

The present invention relates to cutlery dispensers without moving parts that provide one-at-a-time utensil dispensing, specifically to a gravity-feed cutlery dispensing system with no mechanical or moving components involved in the dispensing process, and also comprising one or more easily refillable modules each having a locking valley positioned below a storage channel for prompt, single-serve, sanitary, and tamper-resistant cutlery dispensing. A base unit preferably provides fixed positioning for one or more modules during cutlery dispensing events, and allows high-density storage of ready-to-be-dispensed cutlery in a relatively small footprint (at least 3-4 times the density of prior art cutlery dispensers). Movement of cutlery units within each module is solely by gravity once the next-to-be-dispensed cutlery unit is withdrawn by a user and present invention modules employ no moving parts to activate or assist a dispensing event, hence the locking valley and angled storage of utensils within its storage channel provide important distinctions in the present invention. The storage channels in present invention modules also have a top opening used for loading cutlery, and in addition preferably have a vertically-extending slot on one side that communicates with the top opening and assists in the loading of utensils in bundled stacks for quick, sanitary cutlery refill. However, present invention modules have no vertically-oriented front slot associated with cutlery dispensing. Furthermore, to help achieve locked positioning for a ready-to-be-dispensed utensil, each module's storage channel must be shorter in length dimension than the cutlery intended for dispensing, so that all stacked utensils therein become stored at an angle typically with their protected/sanitary ends above the valley and located at an elevation lower than the elevation of their opposed handle ends that eventually become exposed for dispensing. Once a dispensing event occurs that causes the utensil currently engaging the locking valley to be withdrawn from a module's dispensing opening, gravity immediately causes the bottommost stacked utensil in the storage channel to drop downwardly until the tip of its lower end engages the valley. Thereafter, gravity further causes the still raised end (typically a handle) of the utensil to undergo a small rotation that locks it into a substantially horizontally-extending position for dispensing and also concurrently extends the previously-raised end (handle) through the module's dispensing opening a sufficient amount for easy gripping and withdrawal by a user. All utensils in the storage channel should have the same end (utility end or handle end) positioned to engage the locking valley, with like ends offered through the dispensing opening for efficient utensil positioning within the storage channel and facilitated dispensing. The locked positioning of the ready-to-be-dispensed utensil prevents reinsertion of dispensed utensils and reduces the opportunity for tampering (including the mischievous introduction of other substances inside the modules), thus protecting the sanitary condition of the storage channel and non-dispensed utensils.

In addition, since present invention modules are narrow and would have a tendency to fall over during cutlery dispensing unless properly anchored, a base unit typically supports several of them in side-by-side relation. Base units are also constructed to prevent modules from moving forward when withdrawing forces are applied to utensils during a dispensing event. This side-by-side module storage configuration also allows more dispensing capacity for high-traffic areas than prior art dispensers having the same or similar footprint. Present invention base units can be configured for countertop placement, under-counter placement, wall mounting, or placement on a freestanding pedestal, and may include a lid, door, or other cover with a locking mechanism to prevent unauthorized access to non-dispensed cutlery via the modules' top openings used for cutlery loading. In the alternative, the modules themselves may have temporary covers or other sealing means to enhance the sanitation of non-dispensed cutlery stored therein. Both fixed and removable engagement between modules and their supporting base unit are contemplated. Also, a variety of ways is contemplated for attachment of dispensing modules to a supporting base unit, which will be explained in more detail later in this disclosure. Furthermore, depending upon the application, modules may have multiple-part construction to facilitate manufacturing ease or reduce cost, with pieces remaining easily separable from one another for cutlery reloading or cleaning, or permanently bonded together during manufacture. All modules housed in one base unit may be dedicated to dispensing the same type of cutlery, such as spoons, or used to dispense a variety of different types and/or sizes of cutlery. Furthermore, present invention modules are contemplated mainly for use with disposable plastic cutlery, although in the alternative, they could also be sized and configured to hold non-disposable cutlery. Individual modules can be quickly removed from the base unit when empty, and a pre-loaded replacement module instantly substituted, or in the alternative the module can be easily and quickly refilled (on-site or off-site) with bundled stacks of cutlery inserted through its top module opening (used exclusively for utensil loading and shaped to indicate the type of cutlery to be dispensed). The present invention has a simple and compact construction, as well as many time-saving and cost-saving advantages that are discussed herein below.

BACKGROUND OF THE INVENTION

2. Description of the Related Art

Prior art cutlery dispensers have many disadvantages. Sanitation is an issue, and those with open bins or a receiving chamber for dispensed cutlery (into which a user must insert a hand to retrieve cutlery) present a high risk for cutlery contamination from the environment and prior users. Also, disease can be spread by activation levers, plungers, and other mechanical devices that a user must contact to dispense a utensil. Furthermore, single-serve cutlery dispensers in common use today often only hold about one hundred utensils, which is inadequate in high-traffic areas. In addition, other prior art cutlery dispensers are not tamper-resistant, may be difficult to load with replacement cutlery, are often time-consuming to load with replacement cutlery, and/or compromise the sanitary condition of cutlery during loading. In contrast to the flawed prior art, the present invention is a gravity-feed, single-serve dispenser that has a vertically-extending cutlery storage channel configured for angled stacking of stored utensils. Utensils are loaded longitudinally into refillable modules that can be stacked laterally in side-by-side array, wherein utensils in adjacent modules are substantially parallel to one another to permit one end of a utensil (typically its handle end) to extend outwardly toward a user for easy withdrawal from a dispensing opening. A valley below the present invention storage channel preferably engages the tip of the utility end of a stored utensil released by a dispensing event from the stacked array of utensils, wherein that utensil now becomes the next ready-to-be-dispensed utensil. The release and valley engagement causes the handle end of the utensil to undergo a small rotation and drop into view through a dispensing opening. Thus, a utensil ready for dispensing is no longer angled in orientation, and instead has a substantially horizontally-extending and locked dispensing position that blocks access to, and/or removal of, any of the stacked utensils remaining in the storage channel until another dispensing event occurs. This is critical in preventing contamination of the remaining cutlery pieces. Only withdrawal of the utensil currently in the locked dispensing position (by a user grasping its exposed handle and pulling it outward and away from the dispensing opening) will cause a next utensil in stacked array to concurrently drop down into the locked dispensing position, which continues to block access to, and/or removal of, the non-dispensed stacked utensils remaining in the storage channel until they each sequentially reach the locked dispensing position. Since the next utensil in the present invention channel is instantly dropped down via gravity (and does so without any moving dispenser components), and gravity further rotates the handle of this next utensil to lock it into the dispensing position, reinsertion of a dispensed utensil into the channel is prevented (as well as insertion of anything else), thus preserving the sanitary condition of the storage channel and all utensils exiting it for dispensing. No cutlery dispensing system is known that has all of the features and advantages of the present invention, which include but are not limited to, a synergistic relation between modules and base unit that allows for a cutlery dispensing capacity of at least 3-4 times that of prior art dispensers with the same or similar footprint, no use of dispensing slots or receiving bins that are likely to cause utensil contamination, a locked dispensing position for cutlery that blocks reinsertion of dispensed cutlery into areas where non-dispensed utensils are stored, fast and sanitary module refill through use of bundled stacks of cutlery, and single-serve cutlery dispensing during which a user only touches a utensil's handle instead of any exterior portion of the dispenser during a dispensing event.

There are prior art cutlery dispensers known with no moving parts, wherein the act of dispensing one utensil causes gravity to move the next higher stored utensil downwardly into a dispensing position, and many of these dispensers also have a stated goal of sanitary utensil dispensing. However, each has structure different from that in the present invention and disadvantages that are overcome by the new locking valley and other structure disclosed for the present invention's modules and base units. Several gravity-feed dispensers are mentioned below as examples for comparison/contrast to present invention structure. The dispenser disclosed in U.S. Pat. No. 5,921,408 to Groenewold (1999) has multiple vertically-extending storage channels each with a front slot through which the handles of all utensils stored therein extend prior to dispensing activity. However, the Groenewold invention's front slot is not tamper-resistant and places non-dispensed utensils at risk for contamination. In addition, dispensing occurs by lifting utensils upwardly by their handles and withdrawing them sequentially through a widened portion of the slot at the top of the channel. Should a user remove a utensil, decide not to use it, and then unthinkingly replace the non-used utensil in the channel through the top widened portion of the slot, the utensil immediately under it in stacked array, as well as the inside surfaces of the channel through which all subsequently dispensed utensils must be moved, are likely to experience contamination. Furthermore, a user removing or attempting to grasp the topmost handle in the stacked array is likely to at least touch the handle of the next lower utensil, potentially passing germs and other substances to the next user. The invention in U.S. Pat. No. 2,871,079 to Barrett (1959) also contemplates the dispensing of sanitary utensils and has a lip that provides user access only to the bottommost utensil, which is removed by grasping the edges of its handle and drawing it away from an upright storage shell. However, the Barrett invention only dispenses flat wooden utensils in a horizontally-extending stack, and makes no provisions (as in the present invention) to rotate the handle of the bottommost fork or spoon with a conventional contour shape until it drops into view through the dispensing opening, thus becoming separated from the stacked array for prompt and easy single-serve dispensing. Also, in the present invention, reinsertion of the withdrawn utensil is blocked, providing tamper-resistance, as concurrently with the removal of one utensil, the next utensil in the storage channel instantly takes its place in the locked dispensing position. In contrast, particularly in a situation when relatively few flat utensils remain in the upright Barrett shell, since nothing locks the bottommost utensil in stacked array into its dispensing position, it is conceivable for a user to deliberately reinsert a used utensil into the shell and contaminate the shell's interior in a way that would also expose every subsequent utensil dispensed to contamination as it is dispensed. Also, neither the Groenewold invention, nor the Barrett invention, appears to have provisions for rapid loading of utensils similar to the side slot the present invention's most preferred modules that allow pre-bundled stacks of utensils to be rapidly placed within its storage channel.

Other prior art cutlery dispensers with disadvantages similar to those noted above for the Groenewold and Barrett inventions include the invention in U.S. Pat. No. 2,110,189 to Zeidler, Sr. (1938) which has removable modules each with a front slot and dispensing that requires lifting and rotating the handle of the topmost utensil approximately 90-degrees so that it can be withdrawn through the narrow slot (in contrast, present invention dispensing is faster since a user simply grasps a utensil by its handle and pulls it away from a module, storage of non-dispensed utensils is at an angle that leads to locked dispensing positioning, and in addition the present invention has no exposed front dispensing slot that would otherwise provide an enhanced risk of contamination for non-dispensed utensils and/or an opportunity for tampering). Furthermore, a user attempting to grasp the topmost handle in the stacked array is likely to at least touch the handle of the next lower utensil, potentially passing germs and other substances to the next user. Another prior art cutlery dispenser with disadvantages similar to those noted for the Groenewold and Barrett inventions is U.S. Pat. No. 5,190,168 to French (1993) which discloses a dispenser having a dispensing channel with a front slot, wherein items loaded into a dispensing channel are made available for single-serve dispensing through a widened front opening in communication with the bottom end of the slot. The ready-to-be-dispensed item at the bottom of the French dispensing channel is not locked into its dispensing position to provide tamper-resistance (in contrast, the present invention has no front cutlery dispensing slot to risk contamination of non-dispensed utensils, and furthermore its locked dispensing position of the next-to-be-dispensed utensil does not allow it to move unless pulled toward a user, which immediately drops another utensil into the locked dispensing position and blocks contamination of its storage channel by reinsertion of previously-dispensed utensils).

In addition, several other prior art dispensers can be distinguished from present invention structure, including U.S. Pat. No. 5,295,592 to Thorne (1994) which discloses a gravity-feed dispenser for a column of horizontally-extending stacked articles of rectangular shape that move downwardly within a storage zone toward a dispensing opening. A resilient abutment at the bottom end of the storage zone engages a rear portion of the bottommost stacked article. An inclined support below the stacked array holds in end-to-end relation at least two articles previously released from the storage zone, with one edge of the topmost article on the inclined support remaining in contact with the bottom surface of the bottommost article in the stacked array, thus helping to prevent downward movement of the bottommost stacked article. An end stop connected to the lower end of the inclined support partially extends through the dispensing opening, and allows a portion of the ready-to-be-dispensed article in contact with the end stop to also extend in part through the dispensing opening. As dispensing of the article in contact with the end stop occurs and it is drawn away from the dispenser, gravity moves the topmost article on the inclined support in a downwardly direction toward the dispensing opening. Concurrently and in response to the force of gravity, and also aided by stretching of the resilient abutment, the front portion of the bottommost stacked article (which has no abutment to support it and now has no more support from the topmost article on the inclined support, which has moved downwardly toward the dispensing opening) pivots downwardly until its rotation is stopped by the inclined support wherein it becomes the new 'topmost' article on the inclined support. As pivoting occurs, the resilient abutment stretches to accommodate the diagonal dimension between opposing ends of the rotating rectangular article that exceeds the width dimension of the storage zone. When gravity finally draws the bottommost stacked article fully away from the resilient abutment, the next lowest article in the stacked array drops down into contact with the resilient abutment. In contrast to the Thorne invention, the present invention is able to dispense utensils without a rectangular configuration. In addition, it also provides a locked dispensing position for one ready-to-be-dispensed article separated from the stacked array (whereas Thorne has two articles at a time separated from the stacked array thus allowing for unsanitary conditions), the present invention provides an angled orientation for utensils in its storage channel, and its locking valley has a fixed configuration and no resilient component. Furthermore, U.S. Pat. No. 2,325,604 to Gibbs (1943) also discloses a dispenser with a channel having a front slot that requires removal of a utensil by lifting its handle upwardly within the slot and prior to the utensil exiting the top of the channel it encounters a downwardly-biased hinged latch that promptly closes the top end of the storage/dispensing channel after the utensil moves beyond it, preventing the person withdrawing the utensil from placing it (or anything else) into the dispenser (in contrast, the present invention has no front slot involved in cutlery dispensing or any hinged latch associated with its cutlery storage channel); U.S. Pat. No. 1,693,231 to Gruber (1928) discloses a dispenser requiring removal of a utensil by grasping the middle portion of a laterally-extending utensil in a dispensing chute, after which the next utensil moves down into the most forward position in the chute for future dispensing (in contrast, the present invention has no open dispensing chute that could become a source of tampering or contamination for non-dispensed cutlery as a result of people extending their hand/fingers into it to retrieve a utensil); and U.S. Pat. No. 2,141,684 to Diemer (1938) which discloses a dispenser that drops one utensil at a time from a dispensing channel into a receiving chamber underneath the dispensing channel in response to a user engaging an activation knob or handle. Diemer illustrations show the utility end of the utensil landing closest to the receiving chamber's open end so that a user's fingers moving into the receiving chamber to retrieve a dispensed utensil are most likely to first encounter and touch a portion of the utensil's utility end (instead of its handle end), combined with the risk for contamination resulting from a user having to insert a hand or fingers into the receiving chamber to retrieve a utensil, puts both the receiving chamber and dispensed utensils at risk for contamination (in contrast, the present invention has no activation knob or handle, or other moving parts, and without a receiving chamber that requires insertion of a hand to retrieve dispensed utensils, the risk of contamination to dispensed utensils is significantly reduced). Although mention of the above prior art demonstrates that many types of gravity-feed cutlery dispensers are known, it can be quickly understood that there is much room for improvement, as all of the prior art mentioned have disadvantages that present invention structure overcomes, including but not limited to, easier and more efficient utensil loading, more sanitary utensil loading, higher volume of stored utensils for high-traffic areas, easier and faster utensil dispensing, more sanitary dispensing, and enhanced tamper-resistance for non-dispensed utensils.

BRIEF SUMMARY OF THE INVENTION

The primary objective of this invention is to provide a single-serve, gravity-feed cutlery dispensing system having a simple design and no moving parts for enhanced dispensing reliability. It is also an objective of this invention to provide a cutlery dispensing system for food service that allows the utility ends of utensils to remain sanitary during all phases of loading, storage, and dispensing. A further objective of this invention is to provide a cutlery dispensing system that also preserves the sanitary condition of non-dispensed cutlery, contains a large number of ready-to-be-dispensed cutlery within a comparatively small footprint, reduces the amount of labor needed for reloading modules with new cutlery, reduces the amount of loading time required, and also reduces the risk of cutlery contamination during loading. It is also an objective of this invention to provide a cutlery dispensing system with reusable and easily-loaded modules that are tamper-resistant and reduce operational cost. It is a further objective of this invention to provide a cutlery dispensing system suitable for high traffic areas with an ability to store and dispense approximately 800 units of cutlery as opposed to the typical 140 units of the prior art. Another objective of this invention is to provide a cutlery dispensing system with cutlery storing modules having a strong and durable construction that prevents premature deterioration during handling and long-term use. Yet another objective of this invention is to provide a cutlery dispensing system that is designed to work with cutlery of any design, and will dispense utensils equally well with the handle or opposite end of the bottommost utensil in the stack being offered to a user. It is also an objective of this invention to provide a cutlery dispensing system having reduced environmental impact as a result of its manufacture and use. It is a further objective of this invention to provide a cutlery dispensing system configured for alternative counter-top, under-counter, wall, or freestanding pedestal mounting.

The present invention, when properly made and used, provides a single-serve cutlery dispensing system that comprises a base unit and one or more modules each having a locking valley below a vertically-extending storage channel, with the storage channel being shorter than the length of the cutlery to be dispensed, so that non-dispensed utensils become stacked in the storage channel at an angle. The valley then engages the tip of the utility end of the bottommost utensil and gravity causes the utensil to undergo a small rotation into a substantially horizontally-extending orientation that results in its handle dropping into view through a dispensing opening. This rotation also locks the reoriented utensil into the dispensing position. Thus, the utility ends of ready-to-be-dispensed cutlery in present invention modules remain sanitary prior to and during dispensing. Furthermore, since engagement of one end of a utensil with the valley changes the utensil's orientation to make it ready for dispensing, the design of the present invention is simple and no moving parts are needed to place a portion of a utensil (typically its handle) within easy reach of a next user. Instead, the simple act of the last user pulling on the handle of a utensil in the locked dispensing position, and then drawing it away from the present invention dispenser, concurrently causes a replacement utensil from its storage channel to come into contact with the valley, and then undergo a small rotation that causes it to become locked into the dispensing position for availability to a next user. This simple means of dispensing also prevents mechanical malfunction, which enhances dispensing reliability and promotes long-term use with little or no maintenance (other than refilling empty modules). Furthermore, since only the handles of utensils are typically in view, and there is no exposed slot participating in its dispensing process, the present invention is tamper-resistant and preserves the sanitary condition of non-dispensed cutlery in the storage channel. Also, the locked dispensing position of a utensil prevents any used utensils (or other items/substances) from becoming reinserted into the storage channel and introducing unwanted contamination of the channel and non-dispensed utensils. The present invention system is designed to work with any cutlery design and will dispense utensils equally well with the handle or utility end of the bottommost utensil in the stack being offered to a user (although in food service and other applications needing sanitary dispensing, the handle end is offered to a user). Although present invention modules may have removable or fixed association with a base unit, and modules may be made in multiple parts in fixed or separable relation, removable modules with a two-part separable construction allow for easy loading, refill, and cleaning of modules. External ribbing and preferred alignment posts in many present invention modules also contribute to strong and durable construction therein, which further results in cost-saving manufacture, and when a vertically-extending slot is on one of its sides the slot facilitates loading of bundled stacks of replacement utensils as modules are emptied. Loading of replacement utensils using such a slot is also prompt and produces a reduced risk for utensil contamination. In addition, removable modules provided in side-by-side relation in a base unit provide present invention dispensers with a small footprint, high utensil storage volume, and adaptability, as for some meals the present invention could only offer modules with spoons, and for other meals some of the modules in a base unit could easily be exchanged to also offer knives and forks. Furthermore, with its base unit permitting a side-by-side positioning of modules and utensils being loaded in longitudinal orientation wherein utensils in adjacent modules are substantially parallel to one another, the present invention dispenser can hold four times as many utensils as prior art dispensers having a similar footprint and be very effective (with reduced labor expense) in high traffic areas. Optional holes in the back of a base unit may allow wall mounting of present invention modules, instead of counter-top, under-counter, or pedestal positioning. Thus, the present invention base unit component was created to be a part of a synergistic "system" for cutlery dispensing, and modules attach to it for support. Without the base unit invention there would be no way to create a system that allows the single-serve sanitary dispensing while also having a storage capacity of approximately 4-to-5 times the amount of utensils prior art inventions can hold. It is also important to note that the cutlery dispenser of the present invention is a "system", and independently from one another neither the dispensing modules nor the base unit would have as great a value in commercial applications as they do when used together.

The description herein provides preferred embodiments of the present invention but should not be construed as limiting its scope. For example, variations may occur in surface decoration and informational markings used on its modules and base unit; the height dimension of its base unit and modules; the number and location of mounting holes through the back surface of its base unit, if any; the connection used between modules and base units for module stabilization during dispensing; the materials from which modules and base units are made; the amount and configuration of external ribbing provided in its modules for their reinforcement; the number and location of alignment posts in its modules, if any; and the size and configuration of its base unit's lid, cover, or door (if any), other than those shown and described herein, may be incorporated into the present invention. Thus, the scope of the present invention should be determined by the appended claims and their legal equivalents, rather than being limited to the examples given.

LIST OF COMPONENT NUMBERS

Figure 1:
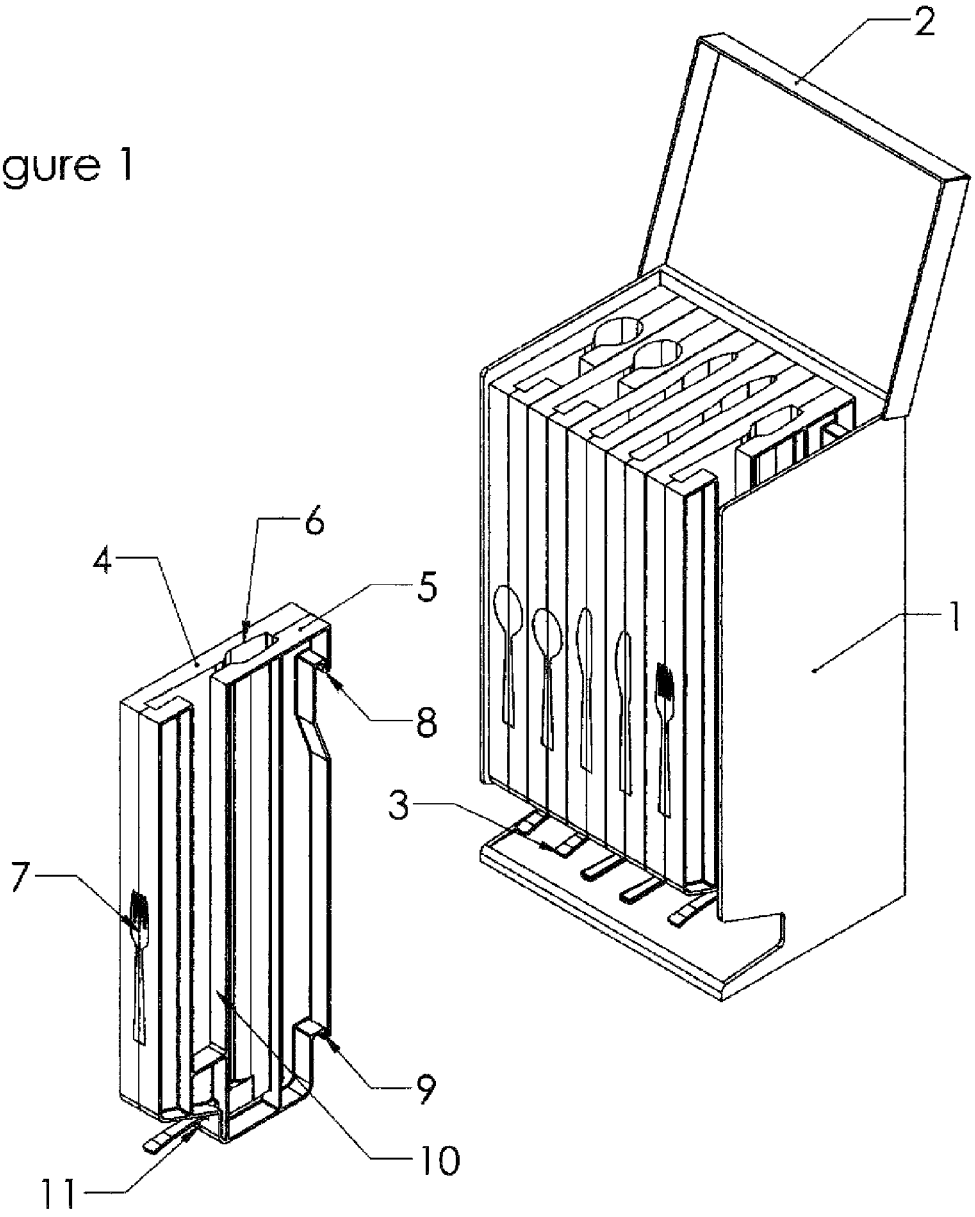
FIG. 1 is a perspective view of the most preferred embodiment of the present invention sanitary, single-serve, gravity-feed cutlery dispensing system from the front, showing six 2-part modules and a base unit, with five of the modules in their desired positions of use supported by the base unit in side-by-side array, and each module showing the handle of a different utensil extending out of the module in a fixed dispensing position that allows dispensing without a user touching any part of the module or base unit, and also with the sixth module shown removed from the base unit and the lid of the base unit shown in its open position that permits module removal and installation.

1—base, base unit, or housing (holds at least one dispensing module—shown in the illustrations herein made from a left module half 4 and a right module half 5, although halves 4 and 5 may be bonded together during manufacture in some applications)

2—lid or cover (when in its closed position, it prevents removal of modules 4/5 from base/housing 1)

3—cutlery/utensil (typically knives, forks, teaspoons, or soup spoons)

4—left half of a dispensing module (supported by base/housing 1—can be identified for fork, knife, or spoon dispensing, via utensil indicators 7)

5—right half of a dispensing module (right half 5 and left half 4 are joined together and then preferably supported by base/housing 1 during cutlery 3 dispensing)

6—loading/holding/storage channel (a magazine of utensils 3 bound together with wrapping tape 17 can be promptly and efficiently loaded into channel 6)

7—utensil indicator (typically fork, knife, teaspoon, or soup spoon)

8—preferred upper hook of module 4/5 (hooks onto a complementary rail 18 in base/housing 1)

9—preferred lower hook of module 4/5 (hooks onto a complementary rail 19 in base/housing 1)

10—vertically-extending slot (it extends through one side of channel 6, and is used for loading multiple utensils 3 at once, and allows the wrapping tape 17 that bundles utensils 3 together prior to loading to be easily removed after a stack of utensils 3 becomes positioned within channel 6)

11—dispensing opening (positioned through the front bottom portion of a module 4/5 below channel 6, which allows one end of a utensil 3 to extend outwardly from the module's 4/5 dispensing opening 11 for easy removal from module 4/5 by a user, while the opposite end of utensil 3 remains sanitary and locked in the dispensing position within module 4/5 until a dispensing event occurs)

12—locking valley (prevents the bottom utensil in the locked dispensing position from falling out of module 4/5)

13—relief area (void space that allows the utility end of bottom utensil 3 to slide/move in a downwardly direction until it becomes engaged with locking valley 12, and also allows sufficient room for the gravity-induced downward rotation of the handle of bottom utensil 3 that causes it to drop it into view for future dispensing while the utensil's orientation undergoes change from an angled positioning into a substantially horizontally-extending orientation)

14—external ribbing (adds strength to modules 4/5)

15—alignment post (six are shown—preferably used to engage a corresponding socket on the other half module, however the size, number, and configuration shown could vary)

16—alignment socket (six are shown—accepts a post from the other half module, however the size, number, and configuration shown could vary)

17—wrapping tape (holds multiple utensils 3 together during storage and while they are placed into holding channel 6 during loading of modules 4/5—when utensils 3 are in their desired positions of use in channel 6, wrapping tape 17 is removed through the vertically-extending slot 10 in one side of holding channel 6)

18—upper hook rail in base unit 1 (supports module hook 8 and holds modules 4/5 in place during dispensing events)

19—lower hook rail in base unit 1 (supports module hook 9 and holds modules 4/5 in place during dispensing events)

20—T-slot connection means used between some modules 4/5 and base unit 1

21—dove-tail slot connection means used between some modules 4/5 and base unit 1

22—round slot connection means used between some modules 4/5 and base unit 1

23—top-loading pocket in some base units 1 each used for insertion of one module 4/5

24—finger-engaging relief area near top of pockets 23

25—front-loading pockets/slots in some base units 1 each used for insertion of one module 4/5

26—longitudinal rail along bottom edges of pockets/slots 25 in a front-loading base unit 1 that positions and holds each module 4/5 in place during utensil-dispensing use.

27—friction-reducing guides

28—relief areas between guides 27 (where no module and cutlery/utensil have no contact)

DETAILED DESCRIPTION OF THE INVENTION

The present invention is a single-serve, tamper-resistant, gravity-feed cutlery dispensing system comprising one or more modules 4/5 that each have a valley 12 at the bottom of a vertically-extending channel 6, with the channel 6 being shorter than the length of the cutlery 3 to be dispensed, so that non-dispensed utensils 3 become stacked in channel 6 at an angle. FIGS. 1-12 show a first preferred embodiment of the present invention, which FIG. 13 shows a second preferred embodiment of the present invention with modules that have friction-reducing guides 27 with relief areas 28 replacing dispensing channel 6 to allow utensils 3 to move more freely in a downwardly direction toward dispensing opening 11. Friction-reducing guides 27 have contact with non-dispensed utensils 3 and relief areas 28 have no contact with non-dispensed utensils 3. The present invention system is designed to work with any cutlery 3 design and will dispense utensils 3 equally well with the handle or the opposed utility end of a utensil 3 (locked below channel 6 in the dispensing position) being offered to a user (not shown). However, for sanitary purposes in food service, it is preferred that the handle end of utensils 3 be offered to users. Furthermore, present invention dispensing occurs with no moving or mechanical parts. Instead, gravity moves stacked utensils 3 downwardly in channel 6 until the tip of one end of the bottommost utensil 3 engages valley 12 and becomes locked into a dispensing position where the opposed one of its ends (preferably its handle) undergoes a small rotation while exiting channel 6, and then dropping into view through the dispensing opening 11 below channel 6 where it remains available for removal by a user. Thus, the present invention is a one-touch dispensing system, wherein dispensing occurs with users only touching the portion of utensil 3 offered through dispensing opening 11, and no part of base unit 1 or modules 4/5 needs to be touched for dispensing to occur. The remaining utensils 3 that are stacked upon and above the utensil 3 now in the locked dispensing position, remain captured within channel 6 where they stay until the ready-to-be-dispensed and currently 'locked' utensil 3 is withdrawn by a user during a dispensing event, which then causes the tip of the next utensil 3 stacked in channel 6 to drop down into the locking valley 12 and further causes a small rotation of the opposing end (preferably its handle) of utensil 3 and its extension beyond dispensing opening 11. Applications of the present invention system may include, but are not limited to, the dispensing of selected sizes and shapes of spoons, forks, and knives in different modules 4/5 all within the same base unit 1, and systems dedicated to the dispensing of one type of cutlery 3 (such as all spoons). Advantages of present invention use include, but are not limited to, enhanced sanitation of stored and dispensed cutlery 3, enhanced counter-space efficiency, a high volume of stored utensils for high-traffic areas while maintaining a relatively small footprint, and reduced labor to load and maintain modules 4/5.

Figure 9A:
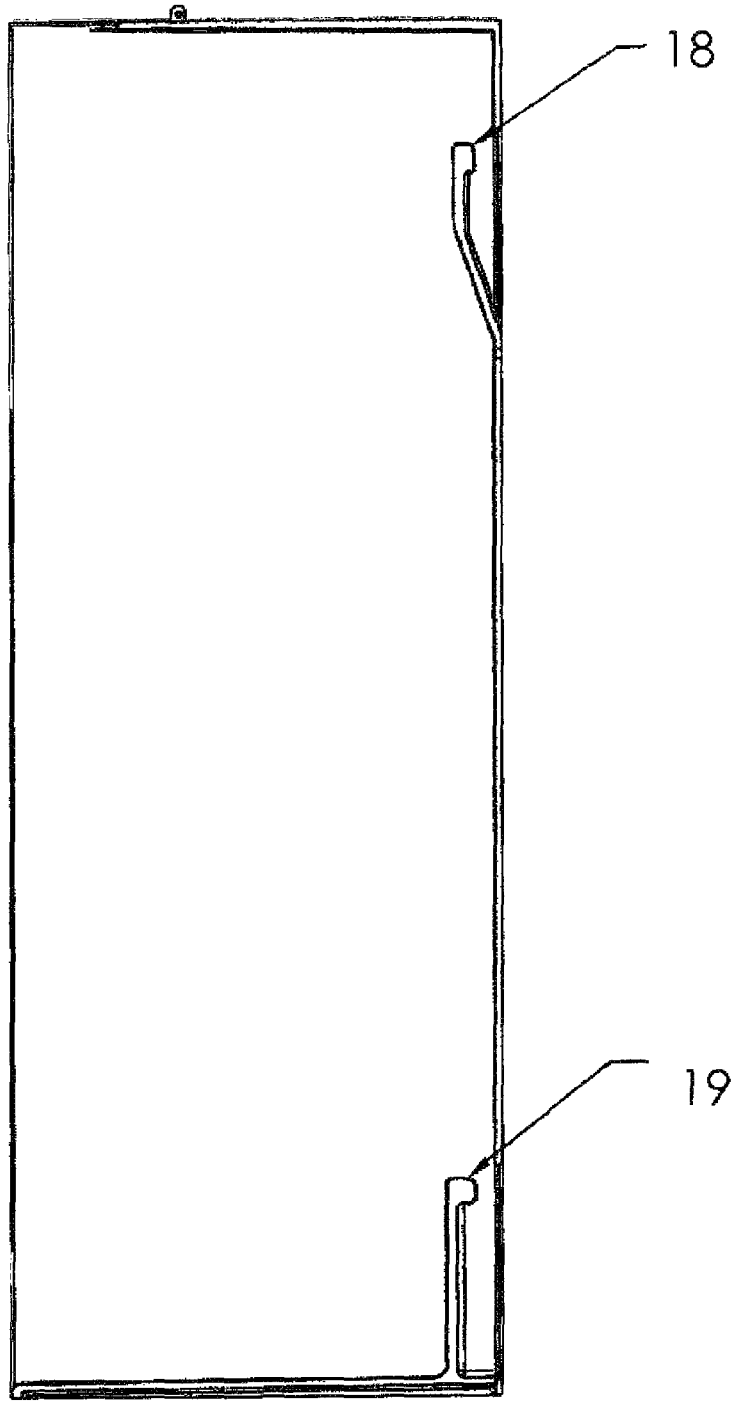
FIG. 9*a* is a section view of a second preferred embodiment of base unit in the present invention that reveals preferred rail configurations, unnumbered mounting holes through the base unit's back surface, and part of a hinge used for lid attachment.
Figure 9B:
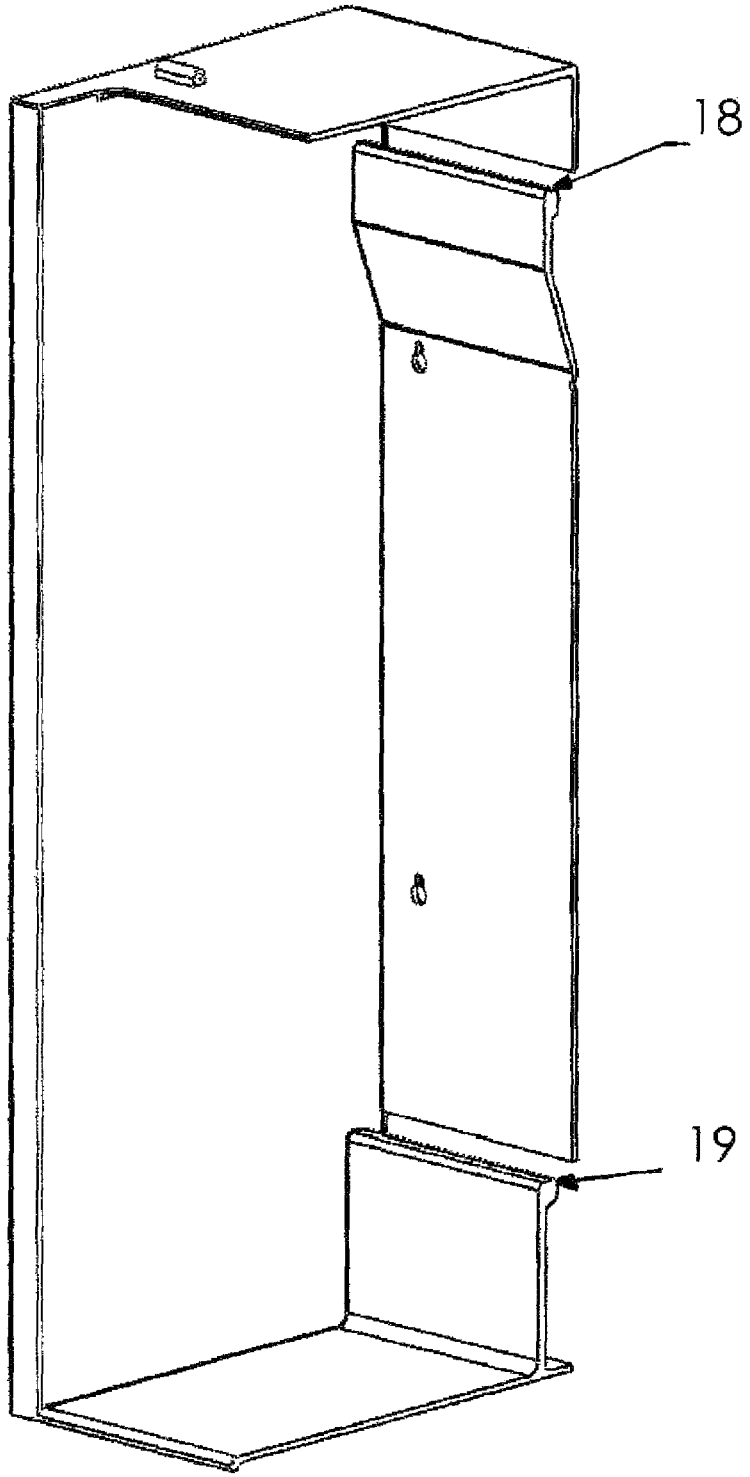
FIG. 9*b* a perspective section view of a second preferred embodiment of base unit shown in FIG. 9*a* that reveals additional structural information about preferred rail configurations and the hinge used for lid attachment.

FIG. 1 is a perspective view of the most preferred embodiment of the present invention sanitary, single-serve, gravity-feed cutlery dispensing system from the front, showing six modules 4/5 and a base unit 1, with five modules 4/5 in their positions of use supported by base unit 1 and each showing a utensil 3 extending through its dispensing opening 11, and also with the sixth module 4/5 shown removed from base unit 1 and the lid/cover 2 associated with base unit 1 in an open position that permits easy and prompt module 4/5 removal and installation. In its closed position (not shown), lid/cover 2 secures the sides of base unit 1 and prevents removal of modules 4/5. Although not shown, a locking means can be used to prevent unauthorized opening of lid/cover 2. In contrast to the base unit 1 shown in FIG. 1, FIGS. 9*a* and 9*b* show a smaller opening in the top portion of base unit 1 used to receive a smaller lid/cover (not shown). Lid/cover 2 may be hinged, snap-fit, lowered into place over modules 4/5, having a sliding relation with base unit 1, or have other association with base unit 1. Base units 1 in differing preferred embodiments of the present invention may also have various sizes so that the number of modules 4/5 used with different base units 1 can vary. It is conceivable that modules 4/5 could be anchored and/or weighted to sufficiently resist the pulling force used by an operator during withdrawal of a utensil 3 from module 4/5, and when so anchored or weighted it is contemplated for a module 4/5 to be used independently from base unit 1. However, base unit 1 was specifically designed for use with modules 4/5, and has no significant commercial value independent from modules 4/5. There is a synergistic relation of modules 4/5 to base unit 1 that allows them to achieve all of the goals and advantages stated in this disclosure, and without base unit 1 as part of the present invention to which modules 4/5 can be attached, there is no practical or economical way for this "Single-Serve Sanitary Module Dispensing System" to logically work in a commercial application. Thus, base unit 1 with its synergistic relation to module 4/5 is preferred, and provides a more tamper-resistant cutlery dispensing system than could be provided by modules 4/5 alone, in addition to many other advantages. Furthermore, it takes the combination of several modules 4/5 situated in side-by-side relation in a base unit 1 to achieve all of the goals and advantages stated herein for the present invention. In addition, although tamper-resistance was not an original goal of this invention, it has become a beneficial result One preferred height dimension for base unit 1 is 24-inches, however, this measurement is arbitrary and not considered critical. In addition, when six modules 4/5 occupy a base unit 1 that is approximately 24-inches in height, the present invention can store and dispense approximately 750-800 utensils 3 before reloading is required. This is about four times the capacity of prior art cutlery dispensers with the same footprint. Also, although not shown and depending upon the type of materials used for base unit 1, it could be weighted or have a high-friction material (such as a pad) or textured markings or feet associated with its bottom surface to facilitate dispensing events. In addition, base unit 1 may be secured permanently in place via adhesives or fasteners, and the like. Furthermore, although FIG. 1 shows the present invention having a lid/cover 2, the use of a lid/cover 2 is optional, and when used lid-cover 2 could be full-size (as in FIG. 1, although it is a structurally weaker option for base unit 1), have a smaller that full-size structure (as in FIGS. 9*a* and 9*b*, a structurally stronger option for base unit 1), be hinged, be completely removable, and/or have a tamper-resistant locking component securing lid/cover 2 to base unit 1 to prevent unauthorized access to modules 4/5. In addition, although it is preferred for modules 4/5 be completely removable from base unit 1 (and there is no known prior art having narrow modules in side-by-side vertical orientation, or ones that are removable), it is also contemplated for the scope of the present invention (with its locking valley 12) to include modules 4/5 having fixed association with a supporting base unit 1. Additionally, although modules 4/5 may be made in multiple parts that are in fixed or separable relation to one another (such as right and left halves 4/5), removable modules 4/5 with a two-part separable construction are preferred and allow for easy loading, refill, and cleaning thereof. Furthermore, since one of the stated goals of the present invention is faster module 4/5 loading (typically 2-minutes instead of the 10-to-15-minutes needed in prior art dispensers to reload cutlery), although the multiple parts of modules 4/5 could be sonic welded together during manufacture or secured together via snaps, screws, or other more permanent/fixed positioning means, easily separable alignment/connection means for modules 4/5 are preferred for most cutlery dispensing applications. Although not shown, another option for present invention modules 4/5 is for the perimeter outline of channel 6 resembling that of the to-be-dispensed cutlery 3 to be defined by an insert. Furthermore, as shown in FIG. 1 (but identified in FIG. 2 by the number 14), preferred modules 4/5 also have external ribs 14 configured and placed to strengthen their structure. The number of ribs 14 used is not critical and may vary from that shown in the accompanying illustrations.

Figure 2:
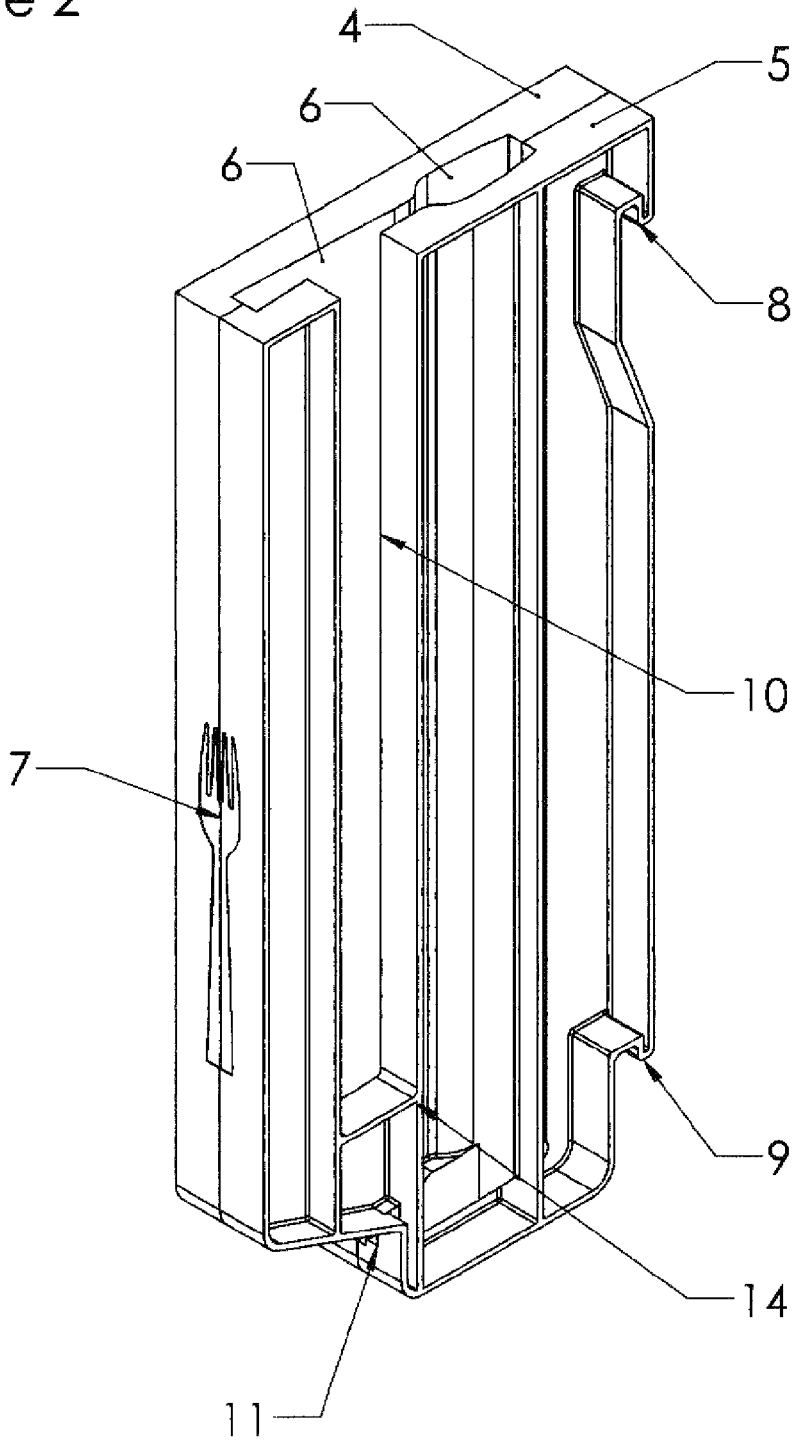
FIG. 2 is a perspective view of a 2-part separable module that is usable as a part of the most preferred embodiment of the present invention and showing it marked for dispensing plastic forks, its fork-shaped channel into which cutlery-to-be-dispensed is loaded, the side slot in the channel that facilitates efficient loading of bundled stacks of cutlery into the channel, the dispensing opening situated below the channel, and the upper and lower hooks on the back of the module that secure it to the base unit during cutlery dispensing.

FIG. 2 is a perspective view of a 2-part module (left half 4 and right half 5, although some present invention modules may have more than two parts) that is usable as a part of a first preferred embodiment of the present invention which shows it marked (with utensil indicator 7) and otherwise configured for dispensing plastic forks 3, the channel 6 into which the to-be-dispensed cutlery 3 is loaded having a top opening configured for fork insertion, the side slot 10 in channel 6 which facilitates loading of bundled stacks of cutlery 3 into channel 6 extending substantially the full height of channel 6, and the spaced-apart upper and lower hooks (respectively marked by the numbers 8 and 9) that secure module 4/5 to complementary rails 18 and 19 (see FIGS. 8, 9*a*, and 9*b*) formed into the interior back wall of the base unit 1 and used for fixed positioning of modules 4/5 during cutlery 3 dispensing. Hooks 8/9 and rails 18/19 also help to maintain modules 4/5 in their upright positions within base unit 1 when one module 4/5 is removed for reloading with replacement cutlery 3. Channel 6 is slightly wider than the cutlery 3 to be dispensed, and it is also shorter than the length of cutlery 3 so that it becomes stacked in channel 6 on an angle. No part of the next utensil 3 can exit channel 6 without removal of the bottom utensil 3 locked into the dispensing position immediately below channel 6. This keeps the remaining utensils 3 within channel 6 out of reach of users, thus eliminating cross contamination and maintaining utensils 3 stored in channel 6 in a sanitary condition until dispensing. FIG. 2 also shows the external ribbing 14 used to add strength to modules 4/5 and the positioning of dispensing opening 11 below channel 6. The amount and pattern of external ribbing 14 used to add strength to modules 4/5 may vary from that shown. Also, the utensil indicator on the front of module 4/5 is intended only as an example, and may be different (in positioning, size, design) on differing embodiments of the present invention. In addition, modules 4/5 and base unit 1 may have any surface decoration or texture, or differing colors to indicate the dispensing of specific types of cutlery 3. Furthermore, although not limited thereto, lightweight plastic materials in many preferred embodiments for the manufacture of modules 4/5 and base unit 1.

Figure 3:
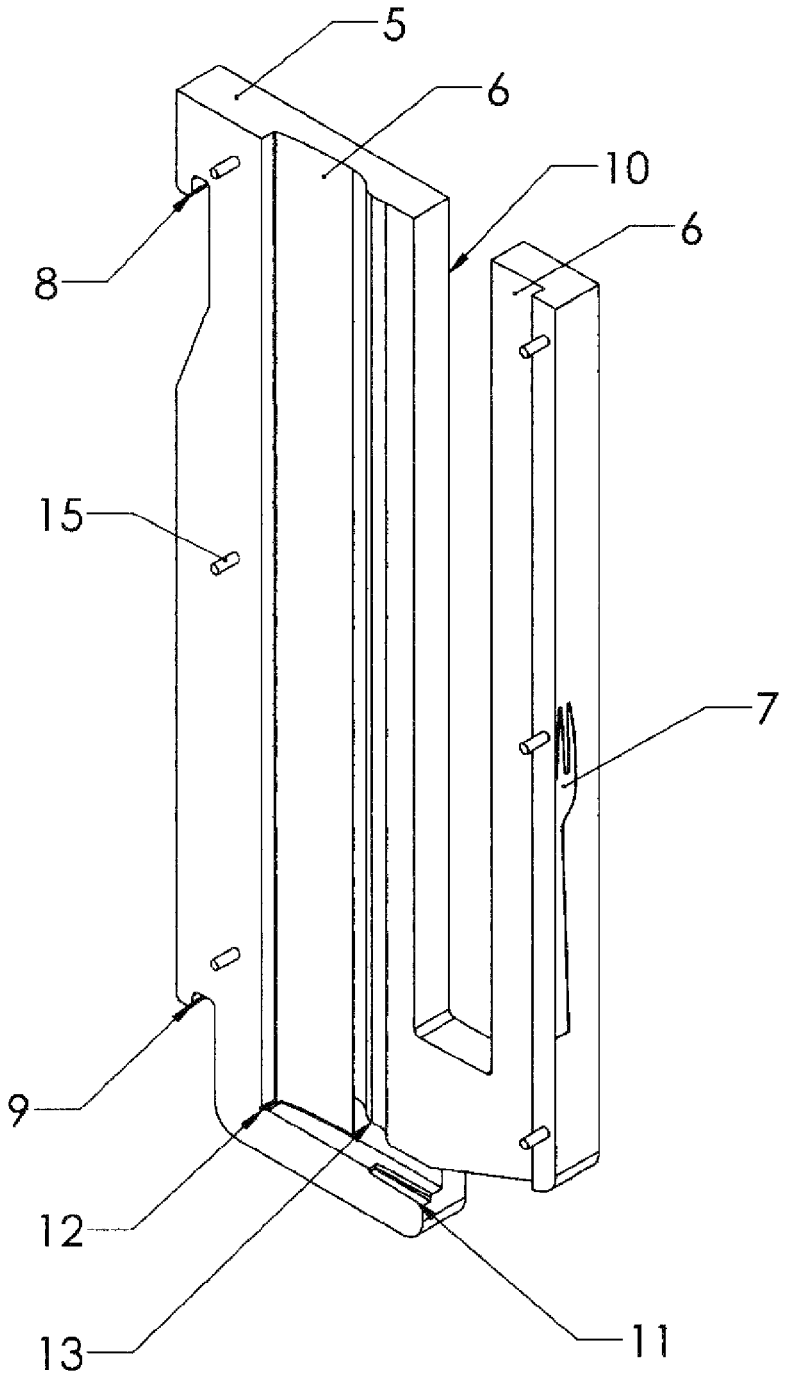
FIG. 3 is a perspective view of the right half of the module shown in FIG. 2, which shows the inside of the module having a vertically-extending slot and part of the channel into which utensils are stacked until gravity allows the utensils one-at-a-time to slide/move downwardly and into to the dispensing position as the utensil immediately below it is withdrawn from the module, with FIG. 3 also showing part of a utensil indicator marked on the front of the module, part of the dispensing opening below the channel where one end of the utensil ready-to-be-dispensed extends outwardly beyond the dispensing opening in the module, the locking valley that prevents the bottom utensil in the locked dispensing position from falling out of the module, the void 'relief' area that allows the bottom stacked utensil to move downwardly and engage the locking valley and also allow sufficient room for rotation of the utensil's handle to cause it to drop it into view through the dispensing opening, the upper and lower hooks that secure the module to the base unit during cutlery dispensing, and multiple alignment posts used for engaging sockets on the left half of the module for temporary connection of right and left halves of the module together during cutlery dispensing (and permits its separation for easy loading of replacement cutlery).

FIG. 3 is a perspective view of the right half 5 of the module 4/5 shown in FIG. 2, which shows the inside surface of module 4/5, including the vertically-extending slot 10 used for cutlery 3 loading (not for cutlery 3 dispensing), and part of the channel 6 into which utensils 3 are stacked until gravity causes the utensils 3 one-at-a-time to move downwardly to the locked dispensing position with its handle extending beyond dispensing opening 11, which occurs after the utensil 3 immediately below it (already in the locked dispensing position) is pulled away from dispensing opening 11. FIG. 3 shows slot 10 and channel 6 being similar in length, with channel 6 slightly longer than slot 10. FIG. 3 further shows valley 12 located at the back/bottom end of channel 6, with dispensing opening 11 in an opposed position at the front/bottom end of channel 6. Relief area is positioned above dispensing opening 11 and beneath slot 10. FIG. 3 also shows the upper hook 8 and lower hook 9 that secure the module 4/5 respectively to complementary configured rails 18 and 19 on base unit 1 during cutlery 3 dispensing, multiple alignment posts 15 used for engaging sockets 16 on the left half 4 of module 4/5 for temporary connection of right and left halves of module 4/5 together during cutlery 3 dispensing use, and part of the dispensing opening 11 in front of channel 6 where one end of the utensil 3 ready for dispensing extends in a forwardly direction for user withdrawal. The number of posts 15 may be different from that shown, and their size, configuration, and placement may also be different as long as they collectively fulfill their connective function. In addition, FIG. 3 shows relief area 13 as a void space above dispensing opening 11 that allows the bottom utensil 3 in stacked array within channel 6 to drop downwardly into the locking dispensing position so that the tip of its utility end becomes engaged with locking valley 12, and then also allows the opposing end of that same utensil 3 to undergo a small rotation that causes it to extend through dispensing opening 11 where it becomes available for user withdrawal. Furthermore, FIG. 3 also shows a portion of utensil indicator 7 (in the form of a fork) on the front of module 4/5, which may be formed during manufacture as a part of the molding process, be in the form of an applied decal, or marked in any other appropriate/different manner with a size, shape, and/or placement similar to or different from that shown in FIG. 3.

Figure 4:
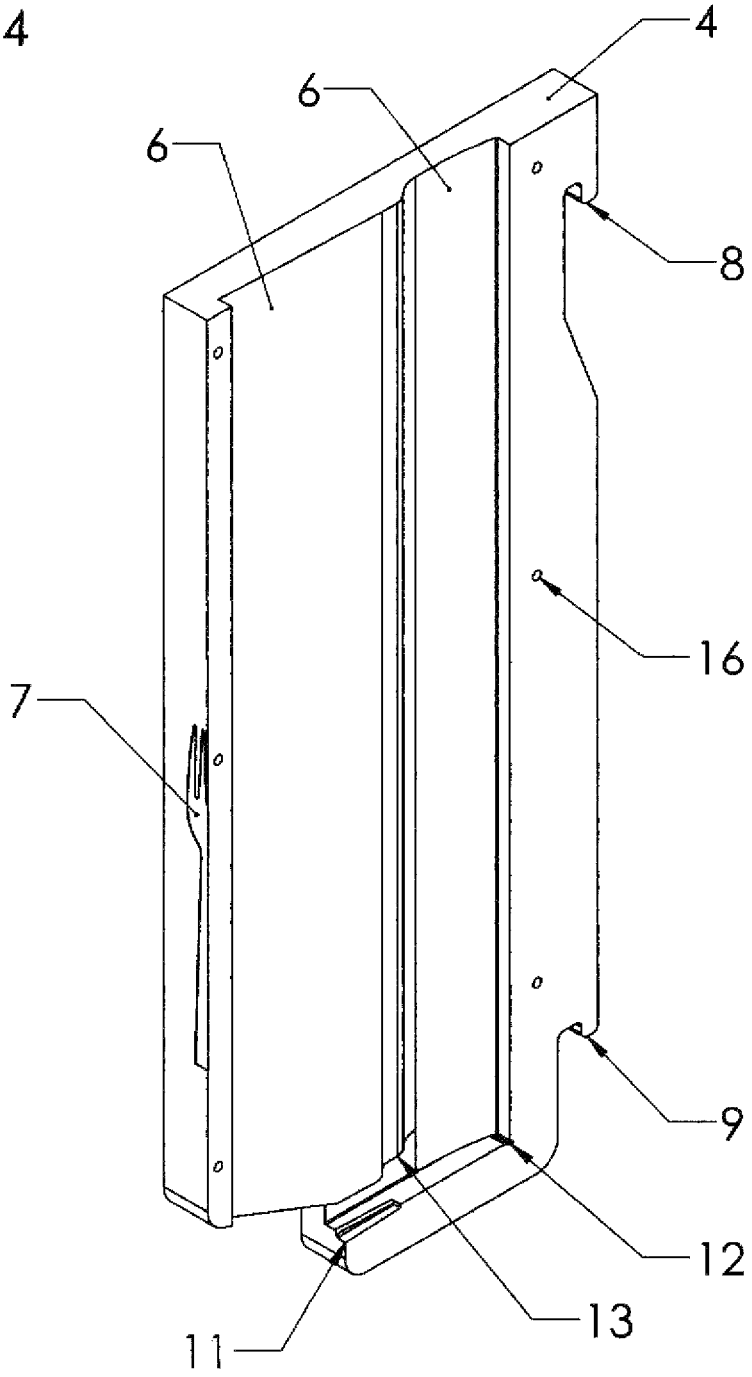
FIG. 4 is a perspective view of the left half of the module shown in FIG. 2, which shows the inside of the module having no vertically-extending slot and part of the channel into which utensils are stacked until single-serve dispensing thereof occurs, with FIG. 4 also showing the upper and lower hooks that secure the module to the base unit during cutlery dispensing, multiple alignment sockets each used for engaging a different one of the alignment posts on the right half of the module for permanent or temporary connection of right and left halves of the module together during cutlery dispensing, part of a utensil indicator marked on the front of the module, the locking valley, part of the dispensing opening below the channel where one end of the utensil ready for dispensing extends outwardly beyond the dispensing opening in the module, and the void 'relief' area adjacent to the dispensing opening.

FIG. 4 is a perspective view of the left half 4 of the module 4/5 shown in FIG. 2, which shows no vertically-extending slot 10 and part of the channel 6 into which utensils 3 are stacked until one-at-a-time dispensing occurs, with FIG. 4 also showing the upper hook 8 and lower hook 9 that secure the module 4/5 to base unit 1 during cutlery 3 dispensing. FIG. 4 also shows multiple alignment sockets 16 each used for engaging a different one of the alignment posts 15 on the right half 5 of the module 4/5 shown in FIG. 3 for temporary connection of the right and left halves of module 4/5 together during cutlery 3 dispensing, a part of utensil indicator 7 that is complementary to that shown in FIG. 3, and part of the dispensing opening 11 in communication with the front/bottom portion of channel 6 and where one end of the utensil 3 ready for dispensing extends outwardly away dispensing opening 11 in a position that is easily grasped by a user. The number, size, placement, and configuration of alignment sockets 16 can be different from that shown, but should be complementary to the alignment posts 15 shown in FIG. 3. In contrast, FIG. 13 provides a perspective view of the left half 4' of a second preferred embodiment of a module in the present invention that is similar in configuration to the illustration of the left half 4 of a first preferred embodiment of a module shown in FIG. 4, with FIG. 13 showing the addition of friction-reducing guides 27 and relief areas 28 replacing the channel 6 into which cutlery 3 is housed until it is dispensed to allow cutlery 3 to move more freely in a downwardly direction toward dispensing opening 11. Although no separate illustration is provided, it is contemplated for friction-reducing guides 27 and relief areas 28 to also similarly replace the channel 6 shown in FIG. 3 to create a complementary right side of a module for the left side of the module shown in FIG. 13.

Figure 5:
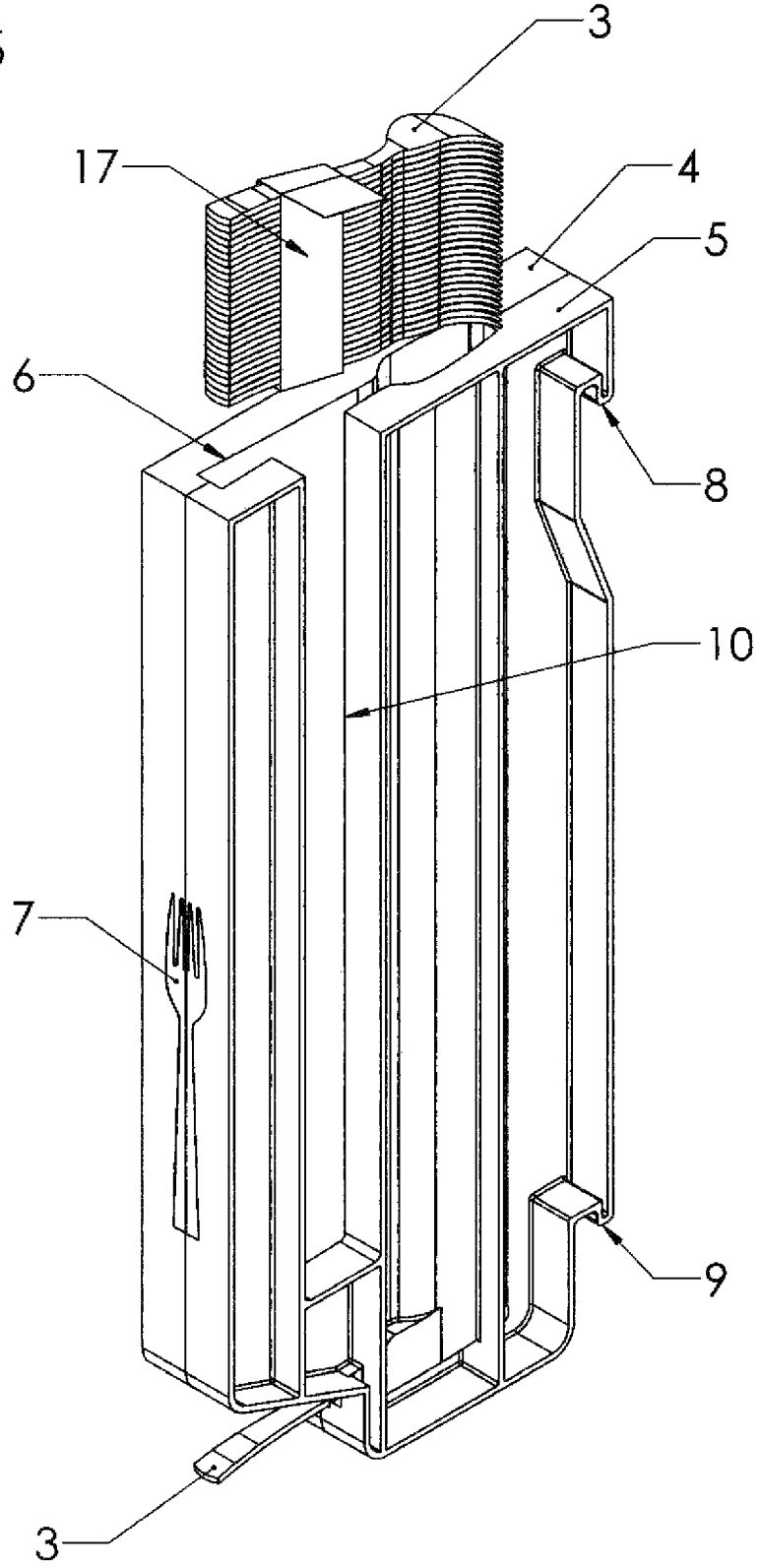
FIG. 5 is a perspective view of the module shown in FIG. 2, which shows one utensil in the dispensing position below the channel and a magazine of utensils bound together with wrapping tape that is ready to be loaded into the channel by sliding all of them together down the loading/storage channel, after which the wrapping tape around the loaded utensils is removed through the slot, with FIG. 5 also showing the top opening in the channel having the outline of a fork, and the magazine of utensils oriented with the handle ends of utensils aligned with the handle end of the top opening in the channel.

FIG. 5 is a perspective view of the module 4/5 shown in FIG. 2, which shows one utensil 3 in the locked dispensing position below loading/storage channel 6 and a magazine of utensils 3 bound together with wrapping tape 17 that is ready to be loaded into channel 6 by moving/sliding all utensils 3 bundled together down channel 6, after which wrapping tape 17 is removed through slot 10, leaving all utensils 3 neatly and promptly stacked within channel 6. The number of utensils 3 per magazine shown in FIG. 5 is merely representative and the number of utensils 3 per magazine may vary from that shown (preferably increased to reduce the labor cost of cutlery 3 refill). Also, the positioning, size, and configuration of the utensil indicator 7 on the front of module 4/5 can also vary from that shown in FIG. 5.

Figure 6:
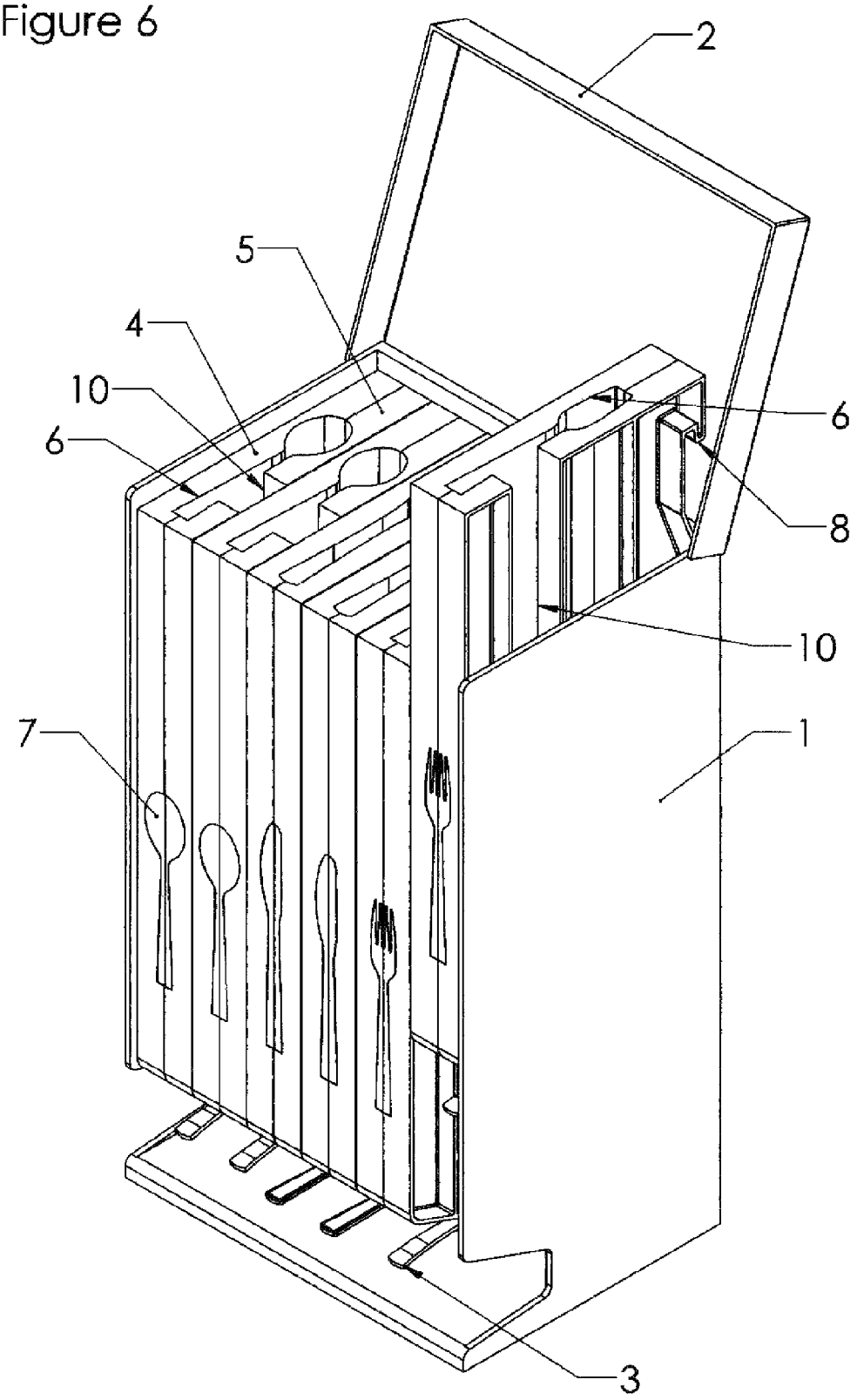
FIG. 6 is a perspective view of the most preferred embodiment of the present invention showing six modules and a base, with five of the modules in place and ready for dispensing the type of cutlery depicted on its front surface, with the sixth module nearly lowered into its locked positioning that is created by its upper and lower hooks engaging complementary rails on the back inside surface of the base unit, with FIG. 6 also showing a handle of a ready-to-be-dispensed utensil extending outwardly from the bottom end of each module, the top openings used for cutlery loading in two modules having a spoon shape, and the lid/cover of the base unit in an open position.
Figure 8:
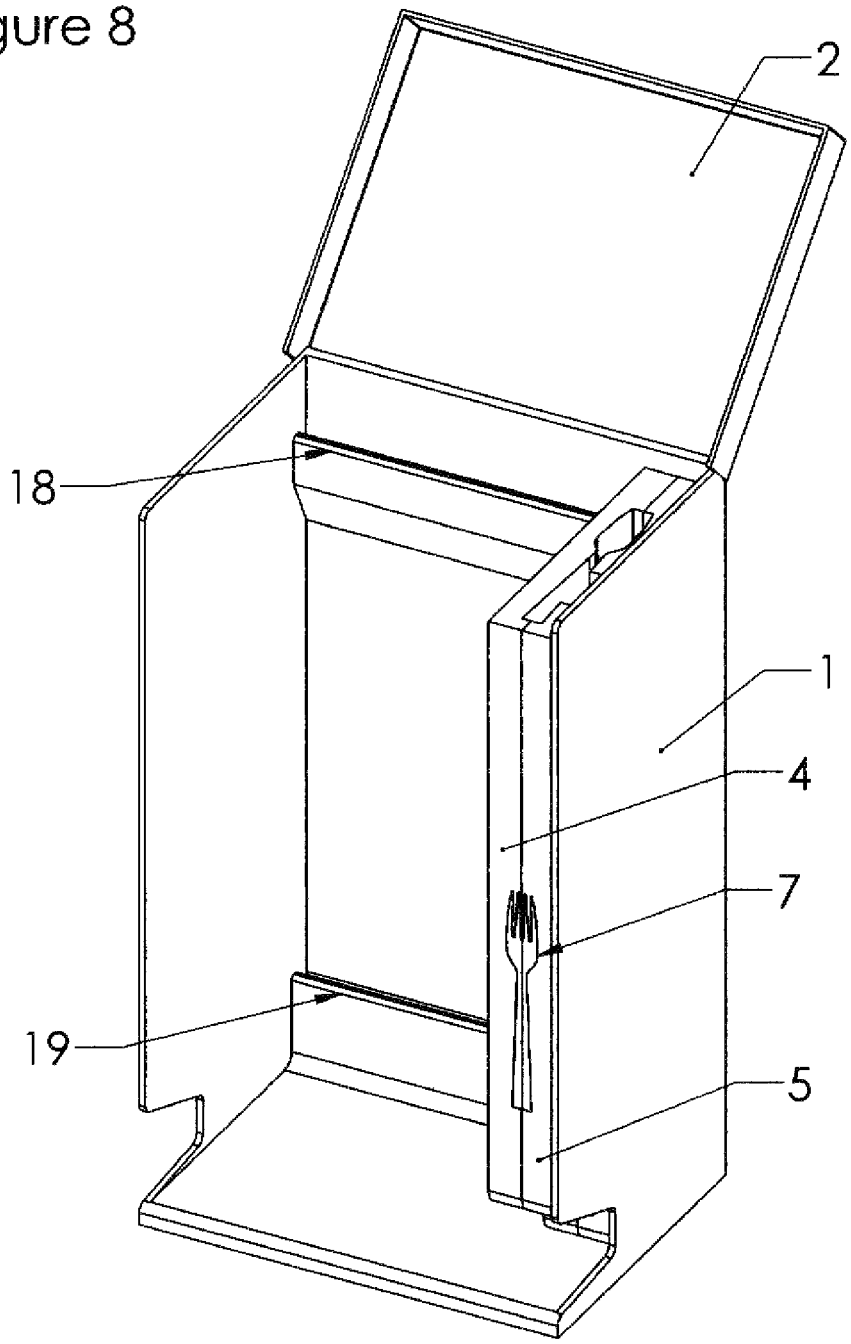
FIG. 8 is a perspective view of the most preferred embodiment of the present invention showing one module and a base unit, with the lid of the base unit in an open position and the module in its desired position of use and ready for dispensing the type of cutlery depicted on its front surface, and further with the back inside surface of the base unit visible and showing the corresponding rails intended for engagement with the mounting hooks on the back of each module.

FIG. 6 is a perspective view of the most preferred embodiment of the present invention showing six modules 4/5 and a base unit 1, with five of the modules 4/5 in place and ready for dispensing the type of cutlery 3 depicted on its front surface by a utensil indicator 7, with the sixth module 4/5 nearly lowered into its locked positioning that is provided by its upper hook 8 and lower hook 9 respectively engaging the rails 18 and 19 in base unit 1 (which are visible in FIGS. 8, 9*a*, and 9*b*). FIG. 6 also shows a handle of a ready-to-be-dispensed utensil 3 extending outwardly from the bottom end of each module 4/5, the top opening in the channels 6 used for cutlery loading in the leftmost two modules 4/5 having a spoon-shaped configuration, and the lid/cover 2 of the base unit in an open position. The loading slot 10 in the rightmost module 4/5 is also visible.

Figure 7:
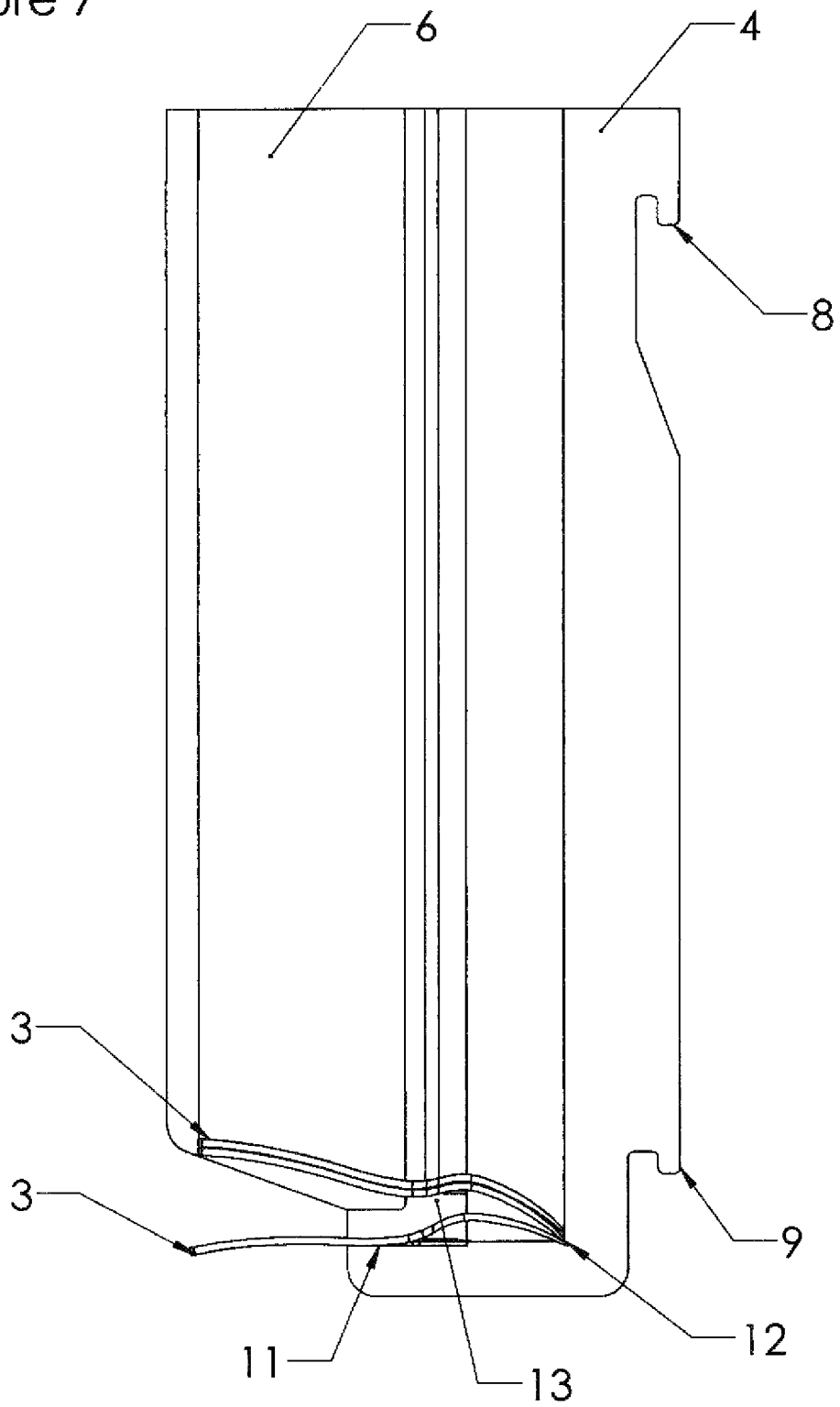
FIG. 7 is a side view looking through the left half of the fork module shown in FIG. 2, and showing one fork in the locked dispensing position and two other forks in the holding/storage/loading channel above it and stacked upon one another with their handles tipped upwardly at an angle relative to the lowered positioning of their tines, and wherein all of the forks positioned in the channel above the one locked into the dispensing position are prevented from falling into the dispensing position by the 'locked' fork engaging the valley. One should note that unless the module is made from translucent or transparent materials, the entirety of the two stacked forks, as well as the tines of the fork in the dispensing position, would be hidden from view and protected from outside contamination or tampering.

FIG. 7 is a side view looking into the left half 4 of the fork module shown in FIG. 2, and showing one fork 3 in the locked dispensing position and two other forks 3 in the holding/storage/loading channel 6 above it and stacked upon one another with their handles tipped upwardly at an angle relative to the lowered positioning of their tines, and wherein all of the forks 3 positioned in the channel 6 above the one locked into a dispensing position are restricted from falling out of module 4/5 by the fork 3 locked into the dispensing position. One should note that unless module 4/5 is made from translucent or transparent materials, the entirety of the two stacked forks, as well as the tines of the fork in the dispensing position, would be hidden from view and protected from outside contamination or tampering. Relief area 13 and the hooks 8 and 9 are also identified in FIG. 7.

FIG. 8 is a perspective view of the most preferred embodiment of the present invention showing one module 4/5 and a base unit 1, with the lid/cover 2 in an open position, and with the module 4/5 in place and ready for dispensing the type of cutlery 3 depicted on its front surface by a utensil indicator 7. FIG. 8 further shows the back inside surface of base unit 1 exposed in order to see the upper hook rail 18 that supports mounting hook 8 on the upper back surface of module 4/5, and the lower hook rail 19 that supports lower mounting hook 9 on the lower back surface of module 4/5. In concert, base upper hook rail 18 and base lower hook rail 19 resist withdrawing forces applied to module 4/5 during utensil 3 dispensing to hold module 4/5 in place within base unit 1. Although not shown in the accompanying illustrations, for enhanced tamper-resistance, it is considered to be within the scope of the present invention to for the lid/cover 2 used with base unit 1 to be secured to base unit 1 with at lease one lock-and-key, combination lock, or other temporary locking mechanism that can be easily removed for loading modules 4/5 with replacement utensils 3 when needed. The size, height, and configuration of rails 18/19 may be different from that shown in FIG. 8, as long as they are complementary to the hooks 8/9 positioned on the back of modules 4/5 intended for use with base unit 1.

Figure 10:
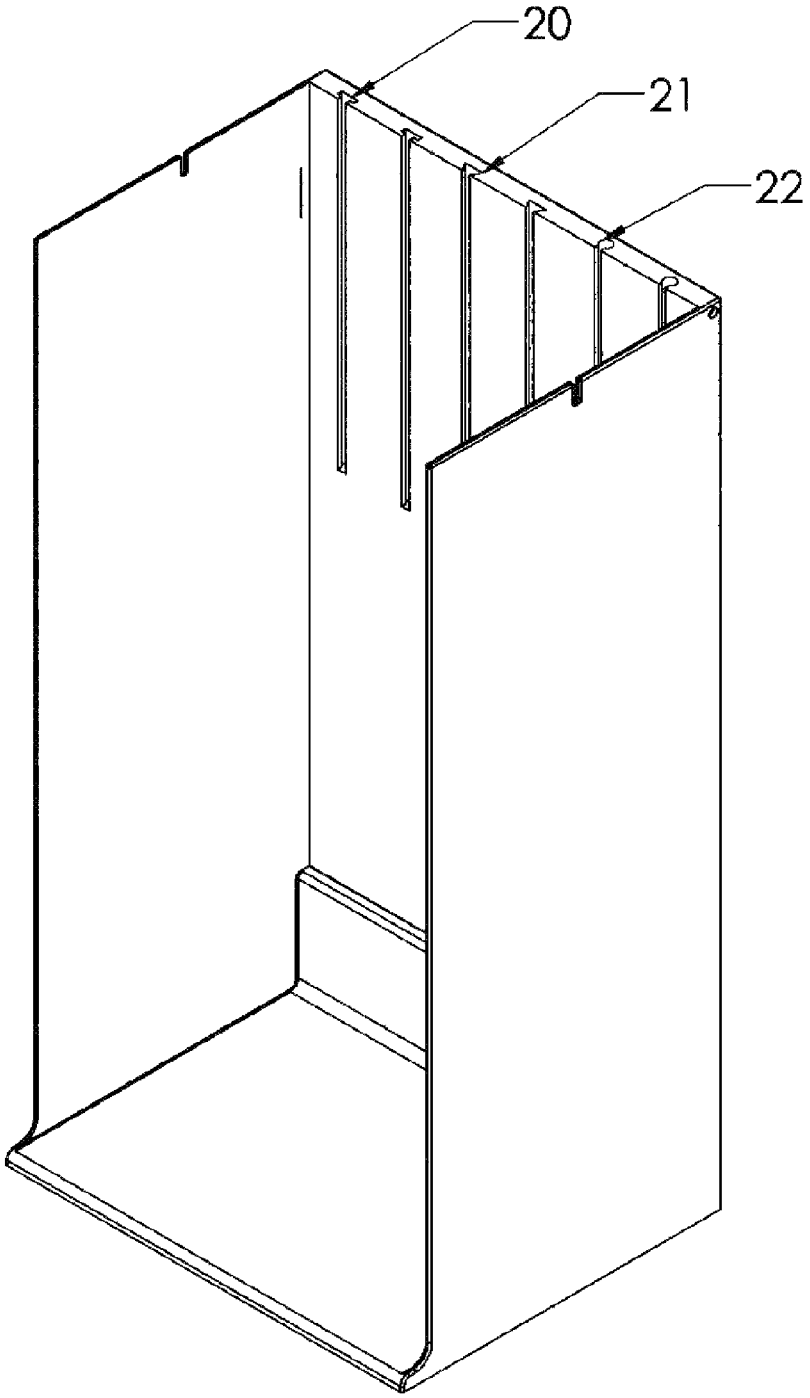
FIG. 10 is a perspective view of a third preferred embodiment of base unit usable as a part of the present invention, which shows three different types of tongue-and-groove connection means for module attachment, including from left-to-right: two T-slots, two dove-tail slots, and two round slots, with unnumbered notches on the top edges of its opposing side walls used for lid attachment of other structural reinforcement of the base unit's top end.
Figure 11:
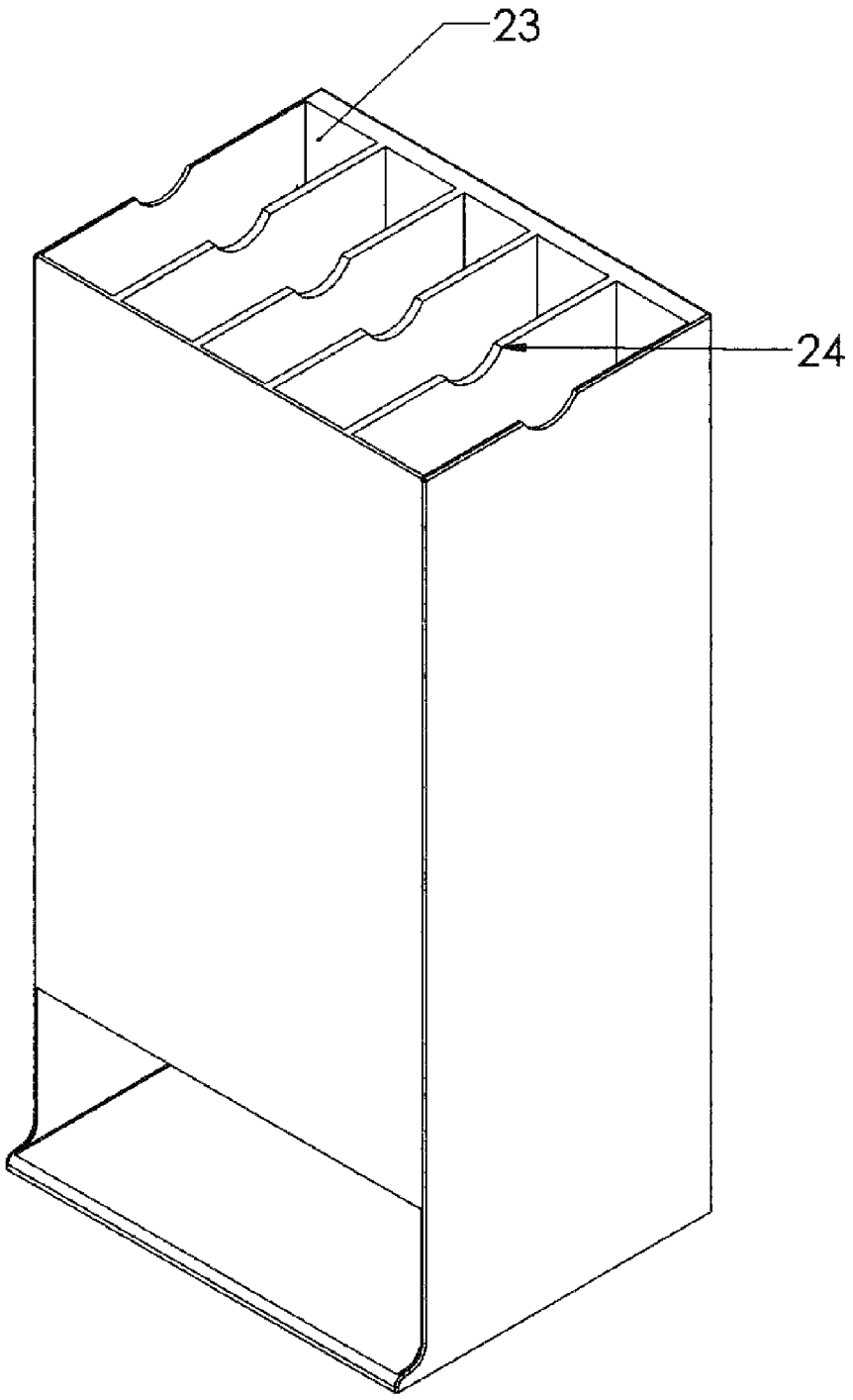
FIG. 11 is a perspective view of a fourth preferred embodiment of base unit usable as a part of the present invention, which shows multiple vertically-extending pockets in side-by-side relation that are each configured to hold one module, with relief areas also shown that allow fingers to grasp opposing sides of a module for its removal from the base unit in an upwardly direction.
Figure 12:
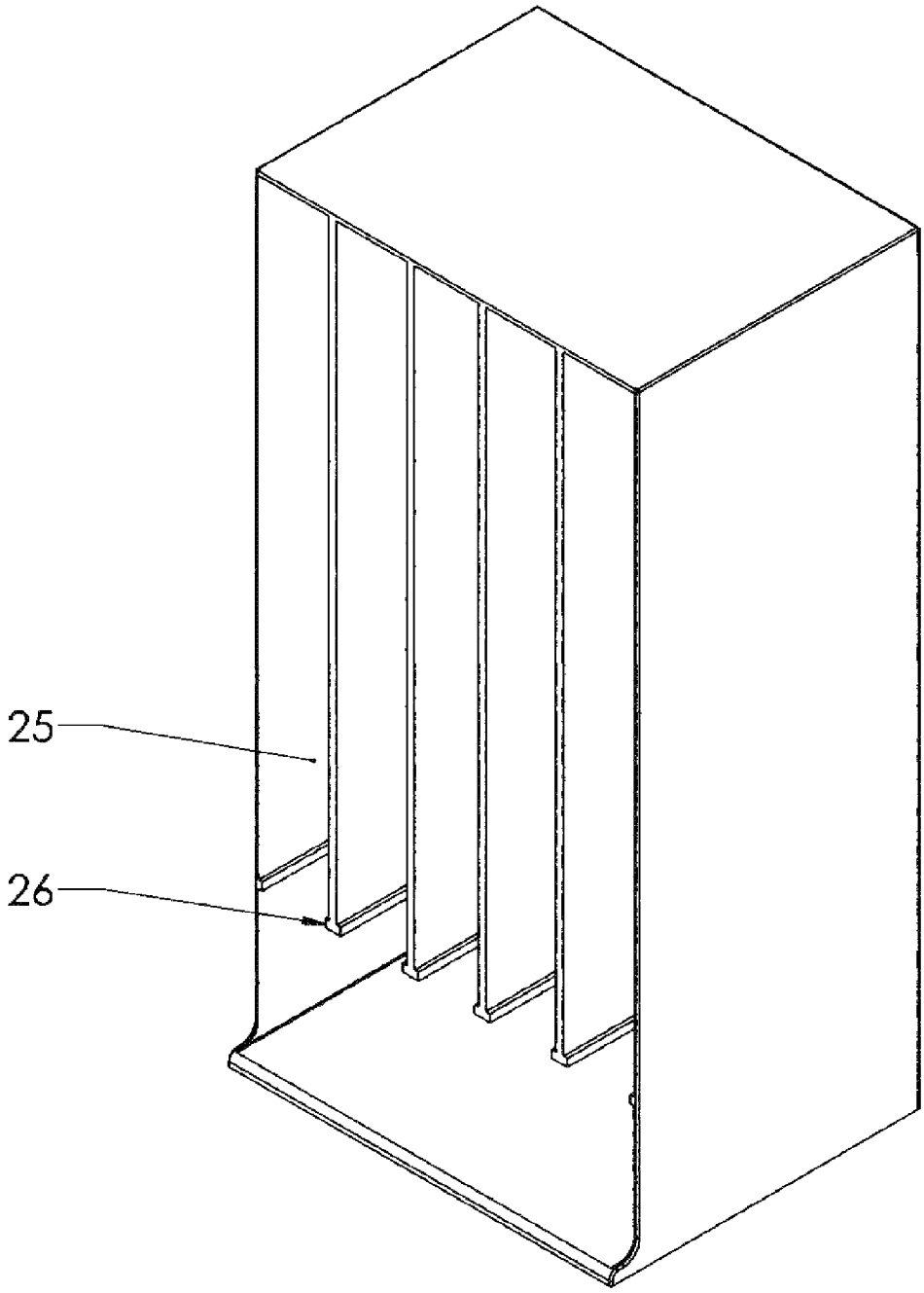
FIG. 12 is a perspective view of a fifth preferred embodiment of base unit usable as a part of the present invention, wherein cutlery-loaded modules are made to slide through the front openings of individual pockets/slots in side-by-side relation in the base unit, with opposed rails at the bottom of each slot used to position and hold each module in place during cutlery dispensing use.
Figure 13:
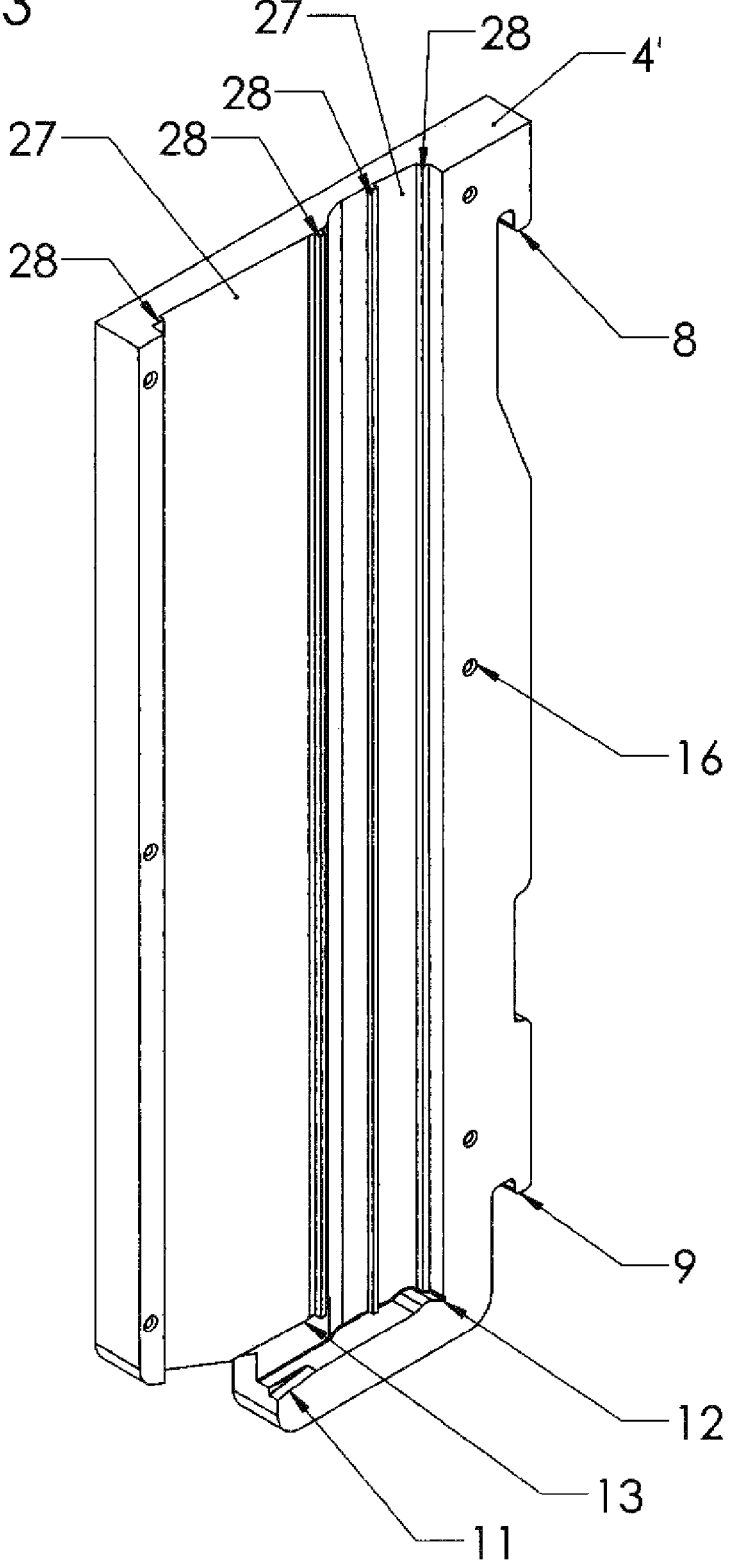
FIG. 13 is a perspective view of the left half of a second preferred embodiment of a module in the present invention similar in configuration to the illustration shown in FIG. 4, with the addition of friction-reducing guides in the channel into which utensils are placed until dispensing to allow the utensils to move more freely in a downwardly direction toward the dispensing position.

FIGS. 9*a*-12 show alternative embodiments of the base unit 1 usable with preferred embodiments of the present invention to secure narrow modules 4/5 in their desired vertically-extending positions of use in side-by-side relation with one another in a relatively small footprint. FIG. 9*a* is a section view from the side of base unit 1 and the most preferred configurations for upper hook rail 18 and lower hook rail 19, while FIG. 9*b* is a perspective view of the same. FIG. 9*a* also shows unnumbered mounting holes through the back wall of base unit 1, with FIGS. 9*a* and 9*b* showing an unnumbered hinge used for attachment of a small/partial lid (not shown). In contrast, FIG. 10 shows a base unit 1 with a tongue-and-groove type of connection means for module attachment that include from left-to-right two T-slots 20, two dove-tail slots 21, and two round slots 22. Although not shown, the modules 4/5 used with this base unit 1 would be modified with complementary mating structure to secure module 4/5 in place during cutlery 3 dispensing events. In addition, FIG. 11 shows a top-loading base unit 1 with multiple pockets 23 each having a top opening into which one module 4/5 can be inserted, with relief areas 24 also shown adjacent to the top openings of pockets 23 for a user's fingers (not shown) to grasp opposing sides of a module 4/5 for its removal from base unit 1 when loading of replacement cutlery 3 is required. Although this embodiment is feasible, it is not most preferred as the base unit 1 is difficult to make (when compared to other embodiments). Furthermore, FIG. 12 shows a base unit 1 wherein modules 4/5 slide into the front thereof via individual pockets/slots 25, with opposing rails 26 also shown at the bottom of each pocket/slot 25 that are used to position and hold each module 4/5 in place during cutlery 3 dispensing use. Although the hook (8/9) and rail (18/19) connection of module 4/5 to base unit 1 (shown in FIGS. 1-8) is the most preferred connection in the present invention, other connections (both fixed and removable) are also contemplated, such as but not limited to snap-in-place (potentially unreliable), twist-lock (moving parts), lever lock (moving parts), pins or posts, back screws, hook-and-loop fastener or fasteners, and/or modules 4/5 sliding into slots 25 and a door (not shown) closing to hold the modules 4/5 in place. The examples given herein show only a few of the enumerable ways that present invention dispensing modules 4/5 can be attached to base unit 1, which can include either removable or fixed attachment means.

The present invention has a simple and compact construction, as well as many time-saving and cost-saving advantages. A synergistic relation between modules 4/5 and base unit 1 that allows for a cutlery 3 dispensing capacity of at least four times that of prior art dispensers with the same footprint. Furthermore, the lack of a front dispensing slot and receiving bin reduces contamination of utensil 3. In addition, a locked dispensing position for cutlery 3 blocks reinsertion of dispensed cutlery 3 into areas where non-dispensed utensils 3 are stored, and the single-serve cutlery 3 dispensing provided by the present invention requires a user to only touch the handle of any utensil 3 instead of any exterior portion of the module 4/5 or base unit 1. If more than one type of utensil 3 is stored in the modules 4/5 grouped together within the same base unit 1, a utensil indicator marking 7 may be applied to the front surface of modules 4/5 for user convenience (and to reduce potential waste). Also, although the base units 1 in the accompanying illustrations only show six modules 4/5 housed therein, base units 1 can be configured to house more or less than six modules 4/5. Furthermore, channels 6 are shaped to the utensil 3 and made just large enough to allow easy loading of utensils 3, however, the tolerance is very critical so that utensils 3 maintain the needed angled orientation for correct engagement with valley 12 prior to dispensing. Although mainly contemplated for dispensing disposable utensils 3, the present invention could also be manufactured for use with non-disposable utensils 3. Also, the present invention dispensing system is not dependent on any specific utensil 3 design, and it can be designed to work with any utensil 3 type or design. Utensils 3 are gravity-fed downwardly within channel 6 until the first utensil 3 moves into the dispensing position. The bottom of feed channel 6 has a valley (or slot) 12 cut into it at the first point of contact, allowing the tip of the bottom utensil 3 in channel 6 to move into the valley/slot 12. Preferably, but not limited thereto, the working end of utensil 3 is positioned and locked into valley/slot 12, so that its handle is offered to a user during dispensing. The configuration of valley/slot 12 effectively locks utensil 3 into an angled and ready-to-dispense position. When the cutlery/utensil 3 is locked in place, the opposite end thereof (the dispensing end) is released from the channel 6 and dropped into view to await user removal by way of a simple pulling force applied to utensil 3 to draw it away from module 4/5. Locking a utensil 3 through use of valley/slot 12 makes the remaining utensils 3 in channel 6 stay therein while resting on the locked and ready-to-be-dispensed utensil 3, and when the ready-for-dispensing utensil 3 is finally removed, the utensil 3 immediately above it drops down into the dispensing position, and undergoes a small rotation that reveals its dispensing end (preferably its handle) through a dispensing opening 11 so that it is available for removal and dispensing by a future user. The present invention is designed so the "undispensed" utensils 3 cannot be contaminated or come in contact with anything outside channel 6.

We claim:

1. A cutlery dispensing system without moving mechanical parts for single-serve and sanitary dispensing of cutlery units each having a first end and an opposed second end, said system comprising:

at least one module having a vertically-extending channel formed therein generally in a shape of the cutlery units to be dispensed therefrom, said channel slightly wider than the cutlery units intended for dispensing, said channel also having a back channel portion holding the first ends of the cutlery units that remain out-of-view and in a sanitary condition until dispensed and a front channel portion holding the second ends of the cutlery units that eventually become exposed for dispensing, said channel also having a shorter length dimension than that of the cutlery units to be dispensed, the cutlery units positioned within said channel in an inclined non-horizontally extending orientation allowing the first ends of stacked cutlery units in said channel to be located at a lower elevation than the second ends thereof that eventually become exposed for dispensing, said at least one module further having a locking valley positioned below said back channel portion, a dispensing opening positioned below said front channel portion, and a void relief area communicating with said dispensing opening and said front channel portion, wherein a positioning event occurs for a bottommost cutlery unit in said channel via gravity alone and without assistance of any moving mechanical parts as a result of a user withdrawing the exposed second end of a cutlery unit extending through said dispensing opening in a dispensing event, and as dispensing of the cutlery unit with its exposed second end extending through said dispensing opening occurs said void relief area allows the bottommost cutlery unit still in said channel to drop in a downwardly direction until its first end leaves said back channel portion and engages said locking valley while said first end concurrently remains in contact with a new cutlery unit now having bottommost positioning in said channel, which then directly causes the opposing second end of a downwardly-dropped cutlery unit to rotate downwardly via gravity into a substantially horizontally-extending and exposed dispensing position for a next dispensing event.

2. The system of claim 1 further comprising a housing configured for supporting said at least one module, said housing and said at least one module each having anchoring features with a configuration complementary to one another that securely maintains said at least one module within said housing during cutlery dispensing.

3. The system of claim 2 wherein said anchoring features comprise at least one hook and at least one hook rail.

4. The system of claim 2 wherein said housing further comprises a lid movable between an opening position permitting removal of said at least one module and a closed position that prevents removal of said at least one module.

5. The system of claim 1 wherein said at least one module has a two-part construction.

6. The system of claim 5 wherein said at least one module further comprises at least one alignment post and at least one complementary alignment socket.

7. The system of claim 1 wherein said at least one module further comprises strength-enhancing external ribbing.

8. The system of claim 1 wherein said at least one module further comprises at least one utensil indicator.

9. The system of claim 1 wherein said channel is replaced by friction-reducing guides alternating with relief areas together formed generally into the shape of the cutlery units to be dispensed therefrom.

10. A cutlery dispensing system without moving mechanical parts for single-serve and sanitary dispensing of cutlery units each having a first end and an opposed second end, said system comprising:

at least one module having at least a two-part construction, a narrow width dimension, at least one alignment post and an alignment socket complementary thereto, and strength-enhancing external ribbing, said module also having a vertically-extending channel formed therein generally in a shape of the cutlery units to be dispensed therefrom, said channel slightly wider than the cutlery units intended for dispensing, said channel also having a back channel portion holding the first ends of the cutlery units that remain out-of-view and in a sanitary condition until dispensed and a front channel portion holding the second ends of cutlery units that eventually become exposed for dispensing, said channel also having a shorter length dimension than that of the cutlery units to be dispensed, the cutlery units positioned within said channel in an inclined non-horizontally extending orientation allowing the first ends of stacked cutlery units in said channel to be located at a lower elevation than the second ends thereof that eventually become exposed for dispensing, said at least one module further having a locking valley positioned below said back channel portion, a dispensing opening positioned below said front channel portion, and a void relief area communicating with said dispensing opening and said front channel portion, wherein a positioning event occurs for a bottommost cutlery unit in said channel via gravity alone and without assistance of any moving mechanical parts as a result of a user withdrawing a exposed second end of a cutlery unit extending through said dispensing opening in a dispensing event, and as dispensing of the cutlery unit with its exposed second end extending through said dispensing opening occurs said void relief area allows the bottommost cutlery unit still in said channel to drop in a downwardly direction until its first end leaves said back channel portion and engages said locking valley while said first end concurrently remains in contact with a new cutlery unit now having bottommost positioning in said channel, which then directly causes the opposing second end of a downwardly-dropped cutlery unit to rotate downwardly via gravity into a substantially horizontally-extending and exposed dispensing position for a next dispensing event.

11. The system of claim 10 wherein said channel is replaced by friction-reducing guides alternating with relief areas together formed generally into the shape of the cutlery units to be dispensed therefrom.

12. The system of claim 10 further comprising a housing configured for supporting said at least one module, said outer housing and said at least one module each having anchoring features with a configuration complementary to one another that securely maintains said at least one module within said housing during cutlery dispensing.

13. The system of claim 12 wherein said anchoring features comprise at least one hook and at least one hook rail.

14. The system of claim 12 wherein said housing further comprises a lid movable between an opening position permitting removal of said at least one module and a closed position that prevents removal of said at least one module.

15. A method for one-at-a-time dispensing cutlery units, said method comprising the steps of:

providing at least one of said modules in claim 1, a plurality of cutlery units intended for dispensing via said at least one module, each said cutlery unit having opposing ends, and a housing configured for supporting said at least one module with said housing and said at least one module each having anchoring features with a configuration complementary to one another that securely maintains said at least one module in a fixed position within said housing during dispensing of said cutlery units;

creating upright positioning for said vertically-extending channel of said at least one module sufficient to cause one of said ends of the bottommost one of said cutlery units later inserted into said vertically-extending channel to rotate downwardly into a horizontally-extending and exposed dispensing position for a next dispensing event;

loading at least two of said cutlery units into said vertically-extending channel of said at least one module allowing the bottommost one of said cutlery units in said channel to drop in a downwardly direction until the one of its opposing ends formerly in said back channel portion of said at least one module engages said locking valley, which then allows the other one of said opposing ends of said bottommost cutlery unit that was formerly in said front channel portion of said at least one module to rotate downwardly via gravity into a horizontally-extending and exposed dispensing position for a next dispensing event;

anchoring and maintaining said at least one module within said housing immobile during dispensing of said cutlery; and a user withdrawing said exposed end of a cutlery unit extending through said dispensing opening which automatically without any additional action by the user allows the bottommost cutlery unit still in said channel to drop in a downwardly direction until the one of its ends formerly in said back channel portion engages said locking valley, which then allows the opposing one of ends said bottommost cutlery unit that was formerly in said front channel portion to rotate downwardly into a horizontally-extending and exposed dispensing position for a next dispensing event.

16. The method of claim 15 wherein said channel has a top cutlery-loading opening and a side with a vertically-extending slot communicating with said top opening, and further comprising the steps of providing said cutlery units in stacked array and bound with wrapping tape with adjacent ones of said cutlery units having like orientation, inserting said cutlery units in said stacked array and bound by said wrapping tape together through said top opening and into said channel, and withdrawing said wrapping tape from said channel through said vertically-extending slot.

17. The method of claim 15 wherein said at least one module has a two-part construction with separable parts, wherein said steps of creating and loading are reversed, and further comprising a step of separating said parts of said at least one module that occurs before said step of loading, and a step of joining said parts of said at least one module that occurs before said step of creating.

18. The method of claim 15 wherein said channel is replaced by friction-reducing guides alternating with relief areas together formed generally into the shape of the cutlery units to be dispensed therefrom.

19. A base unit usable as a part of the system in claim 1, wherein said base unit comprises a configuration for supporting said at least one module, said housing and said at least one module each having anchoring features with a configuration complementary to one another that securely maintains said at least one module in a fixed position within said housing during cutlery dispensing.

20. The base unit of claim 19 further comprising a protective lid over said vertically-extending channel of said at least one module, said lid movable between an opening position permitting removal of said at least one module and a closed position preventing removal of said at least one module.

* * * * *